US007845986B2

(12) United States Patent
Yasumura et al.

(10) Patent No.: US 7,845,986 B2
(45) Date of Patent: Dec. 7, 2010

(54) TORSIONALLY-INDUCED CONTACT-FORCE CONDUCTORS FOR ELECTRICAL CONNECTOR SYSTEMS

(75) Inventors: Gary Yasumura, Santa Clara, CA (US); William F. Wiedemann, Campbell, CA (US); Joseph C. Fjelstad, Maple Valley, WA (US); Para K. Segaram, Brookfield (AU); Kevin P. Grundy, Fremont, CA (US)

(73) Assignee: Interconnect Portfolio LLC, Cupertino, CA (US)

( * ) Notice: Subject to any disclaimer, the term of this patent is extended or adjusted under 35 U.S.C. 154(b) by 0 days.

(21) Appl. No.: 11/123,863

(22) Filed: May 6, 2005
(Under 37 CFR 1.47)

(65) Prior Publication Data

US 2006/0035482 A1 Feb. 16, 2006

Related U.S. Application Data

(60) Provisional application No. 60/569,311, filed on May 6, 2004, provisional application No. 60/580,873, filed on Jun. 17, 2004.

(51) Int. Cl.
*H01R 24/00* (2006.01)

(52) U.S. Cl. ..... 439/637

(58) Field of Classification Search ..... 439/636, 439/637, 592, 80, 852, 816; 361/761
See application file for complete search history.

(56) References Cited

U.S. PATENT DOCUMENTS

| | | | | |
|---|---|---|---|---|
| 2,408,583 | A | 10/1946 | Sions | |
| 2,926,328 | A | 2/1960 | Flanagan | |
| 3,333,226 | A | 7/1967 | Donnelly | |
| 3,786,401 | A | 1/1974 | Jones et al. | |
| 3,829,820 | A | 8/1974 | Hubner et al. | |
| 4,008,939 | A * | 2/1977 | Kinkaid et al. | 439/264 |
| 4,025,148 | A | 5/1977 | Bouley | |
| 4,105,277 | A | 8/1978 | Jacobs | |
| 4,735,588 | A | 4/1988 | Bird et al. | |
| 4,941,853 | A | 7/1990 | Harwath | |
| 5,273,455 | A | 12/1993 | MacLellan | |
| 5,772,474 | A * | 6/1998 | Yagi et al. | 439/660 |
| 6,217,341 | B1 * | 4/2001 | Glick et al. | 439/66 |
| 6,247,938 | B1 * | 6/2001 | Rathburn | 439/66 |
| 6,616,966 | B2 * | 9/2003 | Mathieu et al. | 29/842 |
| 6,719,567 | B2 * | 4/2004 | Billman et al. | 439/65 |
| 6,736,665 | B2 * | 5/2004 | Zhou et al. | 439/482 |
| 6,771,084 | B2 * | 8/2004 | Di Stefano | 324/754 |
| 6,945,827 | B2 * | 9/2005 | Grube et al. | 439/700 |
| 2002/0180473 | A1 * | 12/2002 | Di Stefano | 324/762 |

* cited by examiner

*Primary Examiner*—Chandrika Prasad
(74) *Attorney, Agent, or Firm*—Edward P. Heller, III

(57) ABSTRACT

An electrical connector. An electrical connector comprising a connector body having a first channel and a first conductive element extending through the first channel in a first tip section. The first tip section having a first moment arm that, when forced in contact with a first conductive surface, twists the first conductive element to produce a torsion force. The torsion force holds the first tip section in contact with the first conductive surface.

7 Claims, 29 Drawing Sheets

TORSIONALLY-INDUCED CONTACT-FORCE CONDUCTORS FOR ELECTRICAL CONNECTOR SYSTEMS

CROSS-REFERENCE TO RELATED APPLICATIONS

This application claims priority from, and hereby incorporates by reference in its entirety and for all purposes, U.S. Provisional Application No. 60/569,311, filed May 6, 2004, entitled: "Torsionally-Induced Contact-Force Conductors for Electronic Connectors" and U.S. Provisional Application No. 60/580,873, filed Jun. 17, 2004, entitled: "Torsionally-Induced Contact-Force Conductors for Electronic Connectors II."

TECHNICAL FIELD

The present invention relates to the field of electromechanical interconnection devices and systems.

BACKGROUND

Electrical interconnection systems commonly incorporate vias, or plated through holes, to make electromechanical connections between electrical components and printed circuit boards. However, via can cause significant harm to signal integrity. FIG. 1 illustrates a prior-art electrical connector system in which the electrical connector 101 attaches to a printed circuit board 102, which contains multiple layers 103. A conductive pins 104 are inserted into a plated through holes 105, which consists of a hole 106, drilled through the printed circuit board, and an annular pad 107—both of which are plated with a conductive material. The plated through holes make electrical connections between the conductive pins 104 and signal traces 108 that may be located one or more layers within the printed circuit board. The plated through holes 105 and the annular pads 107 may both act capacitively and harm signal integrity.

Often electromechanical interconnection devices incorporate resilient or spring structures to maintain contact force at the point of connection between electrical components. Different spring conductors may be compared for their ability to produce deflection for the same force applied to the resilient structures used to create the spring effect. Spring conductor structures are generally designed to: (1) establish and maintain sufficient mechanical contact force for the intended application; (2) require the smallest amount of deflection to attain this contact force; (3) have little or no permanent deformation; and (4) require the smallest volume possible.

To address each of these attributes, spring structures are often complicated in nature and difficult to manufacture, particularly when the structures are very small. Complexity of resilient interconnection structures typically increases when electrical components are disposed at various angles to each other, often necessitating curved or irregularly shaped interconnection structures. Bends and twists in conductive elements can degrade signal integrity and increase cost.

FIG. 2 illustrates the prior art of an edge card connector mounted on a mother board. The connector accepts a vertically oriented plug-in card 201 that bends the conductors 202 to produce contact force and establish electrical continuity. The conductors 202 are cantilever beams whose fixed ends 203 are attached to the horizontally oriented substrate 204. The contact forces, which are at the free ends 205 of the cantilever beams, bend the cantilever beams. Cantilever beams do not store energy in a uniform manner throughout their length. The greatest stresses or stored energy per unit volume is at the fixed end 203 of the cantilever beam and are at their lowest at the free ends 205 where the electrical contacts exist. The conductors 202 could be made smaller if they were designed to store energy more uniformly throughout the conductors' volume.

FIG. 3 illustrates prior art wherein cantilever-beam conductors 301 are disposed in an electrical connector at an angle to electrical contact pads 302 on a printed circuit board 303, which is perpendicular to printed circuit board 303 (not pictured at right). The ends or electrical contacts 304 of the cantilever-beam conductors 301 bend to produce contact force between the cantilever-beam conductors 301 and the substrate's electrical contact pad 302.

FIG. 4 illustrates another view of the prior art connector in FIG. 3, illustrating the movement of the cantilever-beam conductors, which requires air voids or gaps 405 within the normally uniform dielectric material forming the transmission line structure. The gaps or air voids 405 constitutes a physical discontinuity reducing the signal integrity of the interconnection. The air voids 405 can be compensated for by adjusting the properties and shape of the other connector parts, but this increases the complexity and cost of the connector. In addition, in FIG. 4, the conductors 301 must bend sufficiently within the air voids 405 to attain the configuration necessary for the correct characteristic or differential impedance. Because the connector's electrical contacts 304 may not mate with the electrical contact pads 302 in a consistent manner, the cantilever-beam conductor's movement may alter the spatial and dimensional requirements necessary to provide the correct characteristic or differential impedance and this alteration may reduce signal integrity.

FIG. 5 illustrates a typical prior art torsion bar conductor. A torsion bar conductor 501 with head 505 is inserted into a two-tined receptacle 502, which exerts a twisting force on the head 505, which twists the torsion bar conductor 501. A high speed signal will encounter sharp corners 504 on the torsion bar conductor 501 creating signal reflections. The tines 503 on receptacle 502 are capacitive stubs. Both the signal reflections and the capacitive stubs reduce signal integrity.

FIG. 6 illustrates a prior art cantilever beam commonly used to create force in electrical interconnection systems. FIG. 6 illustrates a round wire beam 601 of length L, radius r and modulus of elasticity E. It has a fixed section 602 and has a force 603, $F_C$, placed at the unconstrained tip section 604 (which is a moment arm). The force is in a direction perpendicular to the cantilever round wire beam's axis.

Despite these and other efforts in the art, further improvement in cost and performance is possible by simplifying design and lowering manufacturing cost. There is opportunity and need for improvements which will address the gap between present options and future requirements.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION

Figure 1:
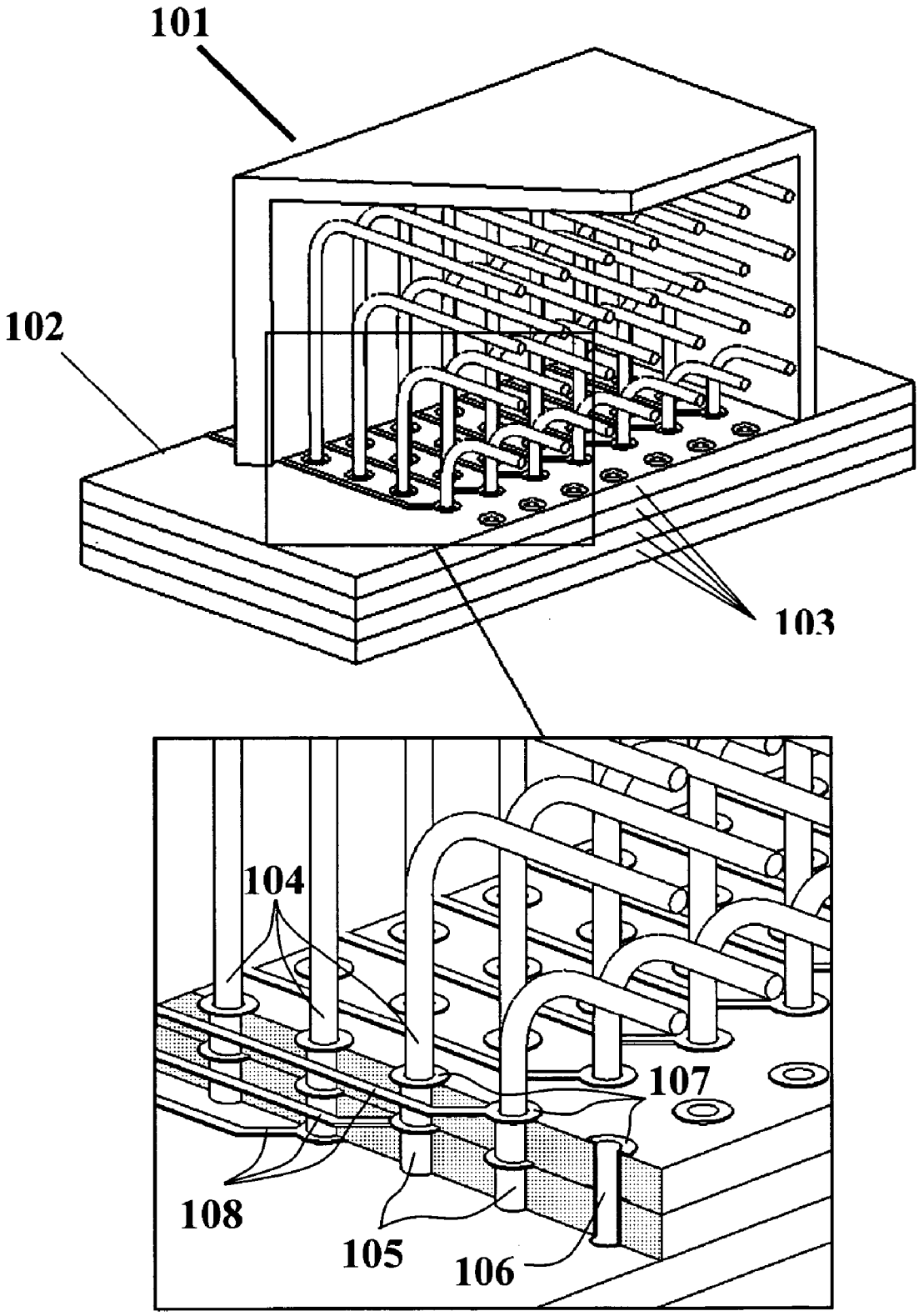
FIGURE 1 PRIOR ART
FIG. 1 illustrates the prior art of electronic interconnect for a printed circuit board assembly.
Figure 2:
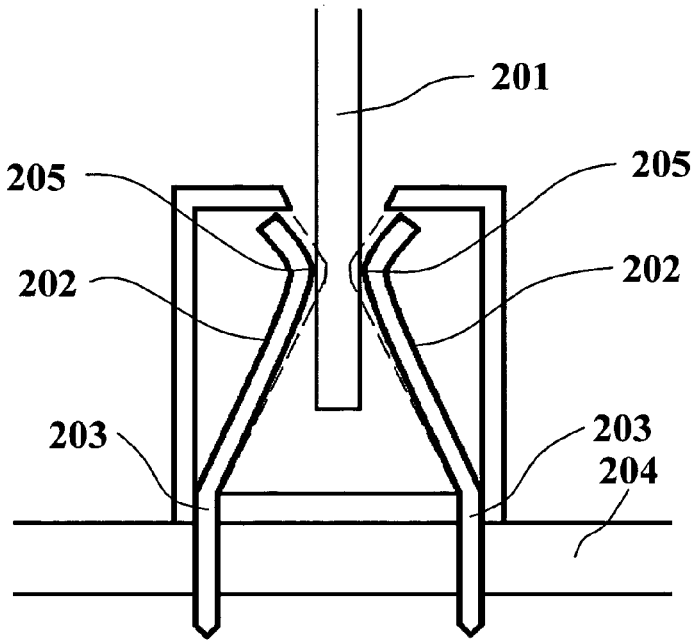
FIGURE 2 PRIOR ART
FIG. 2 illustrates the prior art of an edge card connector.
Figure 3:
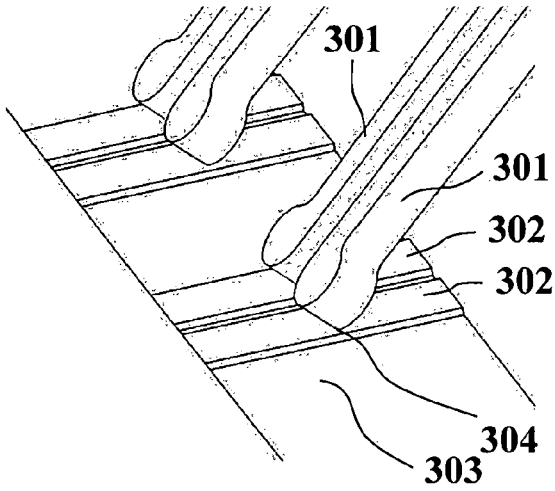
FIGURE 3 PRIOR ART
FIG. 3 illustrates the prior art of a canted cantilever-beam conductors in electrical contact with a substrate's electrical contact pads.
Figure 4:
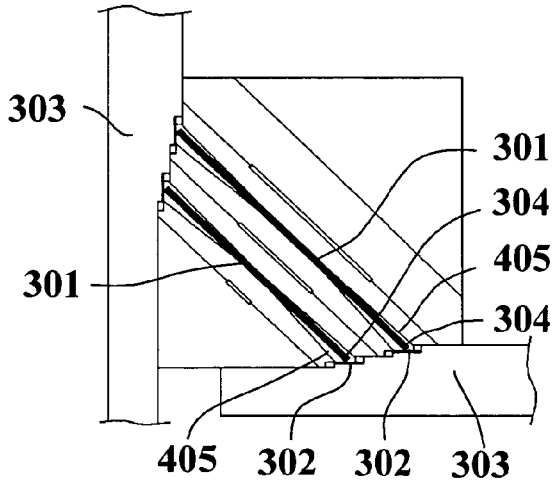
FIGURE 4 PRIOR ART
FIG. 4 illustrates an example of a cross section of the electronic connector in FIG. 3.
Figure 5:
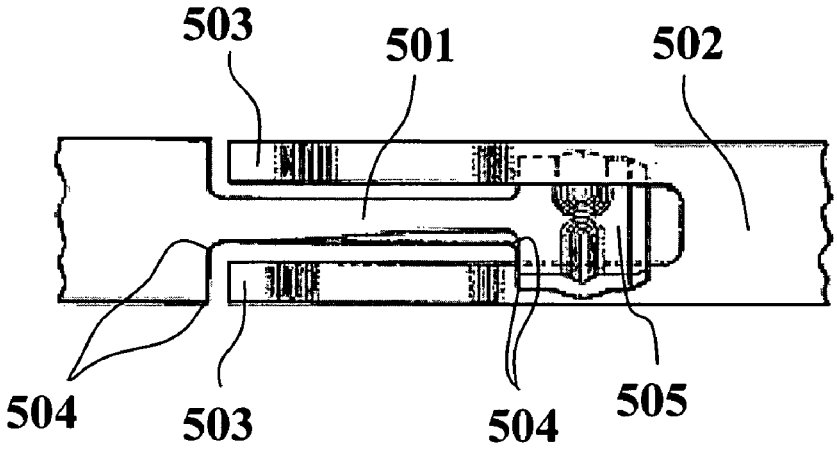
FIGURE 5 PRIOR ART
FIG. 5 illustrates the prior art of a torsion bar conductor inserted into a two-tined receptacle.

In the following description and in the accompanying drawings, specific terminology and drawing symbols are set forth to provide a thorough understanding of the present invention. In some instances, the terminology and symbols may imply specific details that are not required to practice the invention. For example, the interconnection between circuit elements or circuit blocks may be shown or described as multi-conductor or single conductor signal lines. Each of the multi-conductor signal lines may alternatively be single-conductor signal lines, and each of the single-conductor signal lines may alternatively be multi-conductor signal lines. Signals and signaling paths shown or described as being single-ended may also be differential signal pairs, and vice-versa. In the description of any embodiment, when the term electrical component is used, it may include but not be limited to printed circuit boards and other electrical circuit structures including but not limited to printed wiring boards, flexible circuits with layers of metal and dielectric, ceramic or silicon substrates, hybrid circuits, integrated circuits, integrated circuit packages, or a combination of them. Any of the aforementioned items may be substituted for any other aforementioned item. Printed circuit boards may be shown or described at a 90 or 180 degree angle to each other, but unless specifically stated otherwise can be at any other angle.

One or more figures may show two conductors that comprise a differential signal pair. In all such cases, the conductors may be any conductive material such as metal coated plastics, metal, conductive elastomers or conductive plastics. The conductors shown may also be single-ended conductors, single conductors in microwave and stripline geometries, and coaxial conductors. In figures showing a cross sectioned view of the invention, the presence of the cross section implies that there are additional conductors behind and/or in front of the visible conductors. Also, although a conductor may appear to be at a specific angle with respect to a printed circuit board's surface, it may be at any angle with respect to a printed circuit board's surface. The term "dielectric" may be interchanged with the term "insulative".

Embodiments of the invention disclosed herein include electrical interconnection devices and systems having beam-shaped torsion bar conductors with a moment arm at one end or moment arms at each end. The torsion bar conductor creates contact force stored by twisting a torsion section of the device. In these embodiments, torsion structures replace springs, cantilever beams, or other resilient structures to create contact force and store energy. Torsion systems tend to distribute stress more uniformly and efficiently than many other spring-force systems. This efficiency makes it possible to reduce the size of a connection structure by incorporating torsion elements. Torsion bar conductors can also mate with other torsion bar conductors.

In addition, embodiments of the invention disclosed herein include structures and methods for making three dimensional interconnections between electrical components with electrical contacts are arrayed on the connector's stair step surfaces and corresponding electrical contacts on stair step surfaces of electrical components to be mated, such as printed circuit boards. Stair step printed circuit boards shown or described herein may be implemented, for example, as described in U.S. patent application Ser. No. 10/990,280 ("Stair Step Printed Circuit Board Structures for High Speed Signal Transmissions"), filed Nov. 15, 2004, which is incorporated herein by reference. Stair step connections shown or described herein may be implemented, for example, as described in U.S. patent application Ser. No. 11/055,579 ("High Speed, Direct Path, Stair-Step Electronic Connectors with Improved Signal Integrity Characteristics and Methods for Their Manufacture"), filed Feb. 9, 2005, which is incorporated herein by reference. Redundant contact structures shown or described herein may be implemented, for example, as described in U.S. patent application Ser. No. 11/093,266 ("Electrical Interconnection Devices Incorporating Redundant Contact Points for Reduction of Capacitive Stubs and Improved Signal Integrity") filed Mar. 28, 2005, which is incorporated herein by reference.

Figure 6:
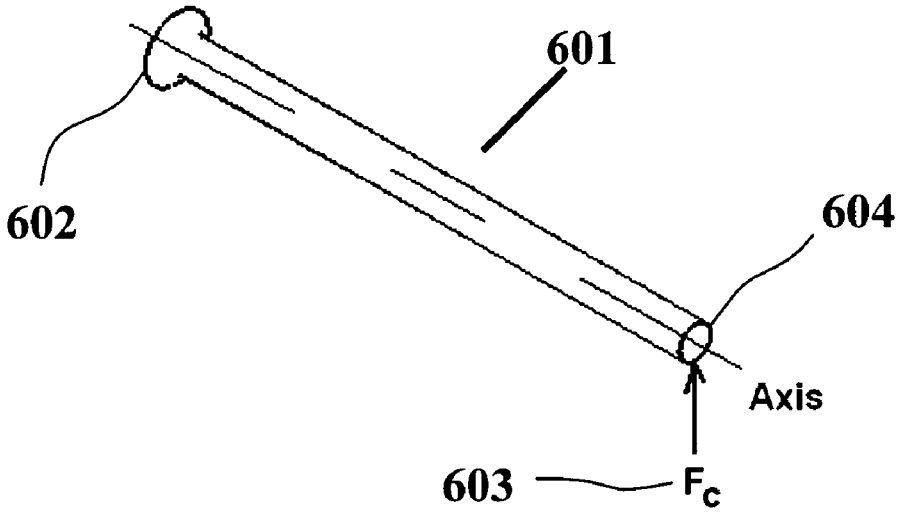
FIGURE 6 Prior Art
FIG. 6 illustrates a section of a cantilever round wire beam spring conductor.
Figure 7:
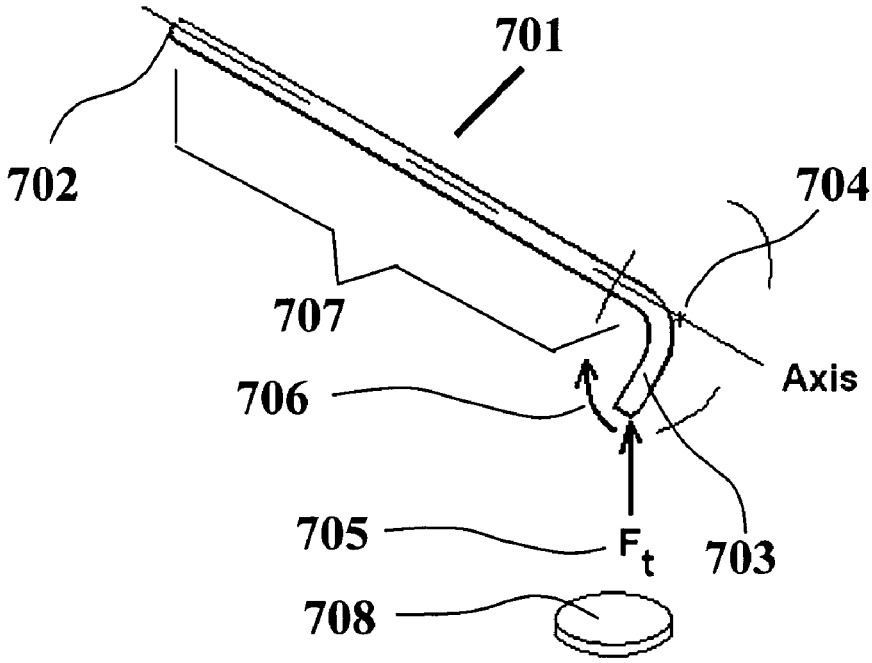
FIG. 7 illustrates an embodiment with a fixed section, a torsion section and a tip section (that forms a moment arm)

FIG. 7 illustrates a torsion bar conductive element 701 that may have the same length, radius and modulus of elasticity as the conductive element described above in reference to FIG. 6. The torsion bar conductive element 701 has a fixed end 702, and a torsion section 707 attached to a tip section 703. The tip section 703 projects away from (i.e., is at a nonzero angle with respect to) the longitudinal axis of the torsion section 707 (perpendicular in the particular example shown) to form a moment arm. A restraining structure (not shown in FIG. 7) can restrain or otherwise secure the fixed section 702 of the torsion bar 707 so that the torsion bar may twist about the longitudinal axis. A channel (e.g., a hole in a connector body or groove on a surface of the connector body, not shown in FIG. 7) may be provided to maintain the orientation of the longitudinal axis of the torsion section while the torsion section is twisted.

In general, the forces produced by each spring conductor are set equal to each other. In other words, $F_c$ is set equal to $F_t$, where $F_c$=loading force at tip of cantilever round wire beam 601 and $F_t$=loading force at tip of moment arm on torsion bar conductor 701. The cross sections perpendicular to the axes in FIGS. 6 and 7 are shown as being round, but they may be square, rectangular or some other shape as long as the shape chosen and its dimensions are the same in each figure. Values E, r, L are equal in each type of spring conductor. For this example, the length of the moment arm equals 1.27 mm (0.05 inches). Poisson's ratio nu is set equal to 0.3 for both spring conductors, which is a common value for spring materials. Under these conditions it can be shown that the deflection $d_c$ of the cantilever round wire beam spring 601 is several times the deflection $d_t$ of the torsion bar conductor 701. Thus the torsion bar conductor 701 tends to be more efficient at producing force within a fixed volume than the cantilever round wire beam 601 and may be volumetrically smaller.

FIG. 7 illustrates an embodiment in which the torsion bar conductive element has a tip section 703 at one end, the tip section having a bend 704 that projects the tip section 703 away from the axis of the torsion section to form a moment arm, a torsion section 707 that is shown as straight but may be a curved (e.g. having one or more bends), and a fixed section 702 that may be conductively attached to conductive entities such as wires or signal traces in circuit structures not pictured at left. When a conductive surface, in this case electrical contact pad 708, is forced in contact with the tip section 703, a torsion force 705 is produced to rotate the tip section and twist the torsion section 707 in the direction shown at 706. As mentioned, the torsion bar conductor 701 can be made volumetrically smaller than the cantilever round wire beam 601 but have the same electrical contact force when electrically mated. Yet another potential advantage is that the torsion bars 707 tend not to deviate substantially during electrical mating so that when the torsion bar conductor 701 is an element of a transmission line, the transmission line's characteristic impedance is also substantially unchanged. Yet another potential advantage is that the torsion bar conductor 701 can be fabricated from drawn wire whose diameter can be closely held to a very small tolerance so that the characteristic or differential impedance and the contact force remain within a smaller value range. Together or individually, these potential advantages may improve high frequency signal integrity. It should be noted that, while the moment arm is formed by a bend 704 in the tip section 703 in the embodiment of FIG. 7, the moment arm may be formed by any projection of the conductive element (or a member connected thereto) away from the longitudinal axis of the conductive element 702. For example, a cam or flat member may be formed integrally with or secured to the conductive element to form a projection away from the longitudinal axis, thereby forming the moment arm.

Another potential advantage of using a torsion bar conductor 701 for producing contact force in an electrical connector is ease of manufacturing. The torsion bar conductor can be shaped easily in a four slide bending tool, progressive die or other manufacturing method and placed on a holding reel for later assembly into connector housings.

Figure 8:
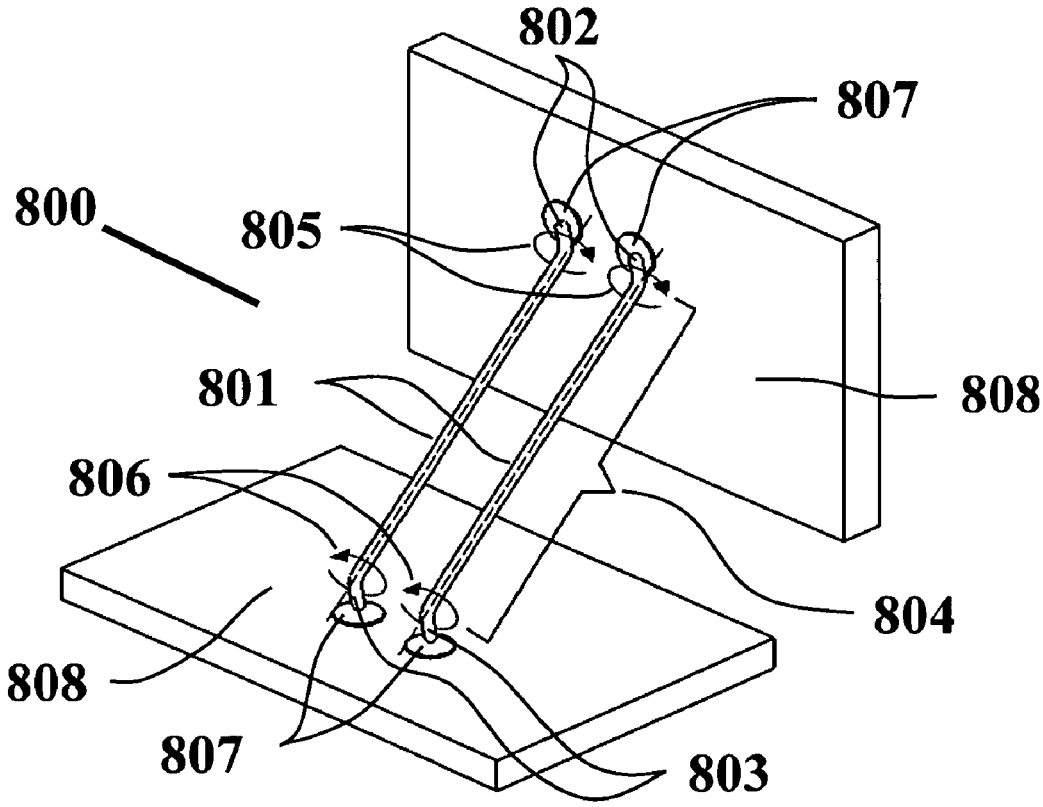
FIG. 8 illustrates an embodiment with a torsion bar section and two tip sections (that form moment arms) which twist about the torsion section.

FIG. 8 illustrates an embodiment in which an electrical interconnection device 800 includes a conductive element 801 composed of a torsion section 804 and two tip sections 802, 803 set at an angle to the torsion section 804. The tip sections 802, 803 twist around the axis of the resilient, torsion section 804. The tip sections 802, 803 are disposed at an angle to the conductive pads 807, and to the torsion section 804, such that as electrical components 808 are moved toward torsion connector 801, the tip sections 802, 803 rotate in opposite directions. The tip sections are moment arms and the direction of the moments are illustrated by the arrows 805 and 806. The extreme ends of the moment arms 802, 803 act as electrical contacts. When the electrical contact areas 807 on electrical components 808 are moved toward the tip sections 802 803 of the torsion bar conductors 801, an electrical interconnection is created. The torsion bar conductors 801 can be canted at various angles with respect to electrical components 808. Insulating structures with closely conforming channels, not shown in FIG. 8, surround the torsion section 804 of the torsion bar conductor 801, allowing the torsion section 804 to rotate but preventing the torsion section from buckling or having its axis substantially deviate from its rest position. Restraints within assembled parts of the electrical interconnection device 800 can hold the moment arms 802 and 803 in a pre-twisted condition before electrical mating has occurred. This creates a predetermined residual stress within the torsion bar conductors 801 when the electrical interconnection device is not mated with another electronic component. As a result of this predetermined residual stress, an adequate contact force can be reached quickly as soon as the electrical connector begins to mate and the moment arm lifts off a restraining wall. This reduces the space required to bring the moment arm into a position where adequate contact force is achieved. Two torsion bar conductors placed side by side may be a differential pair.

Figure 9:
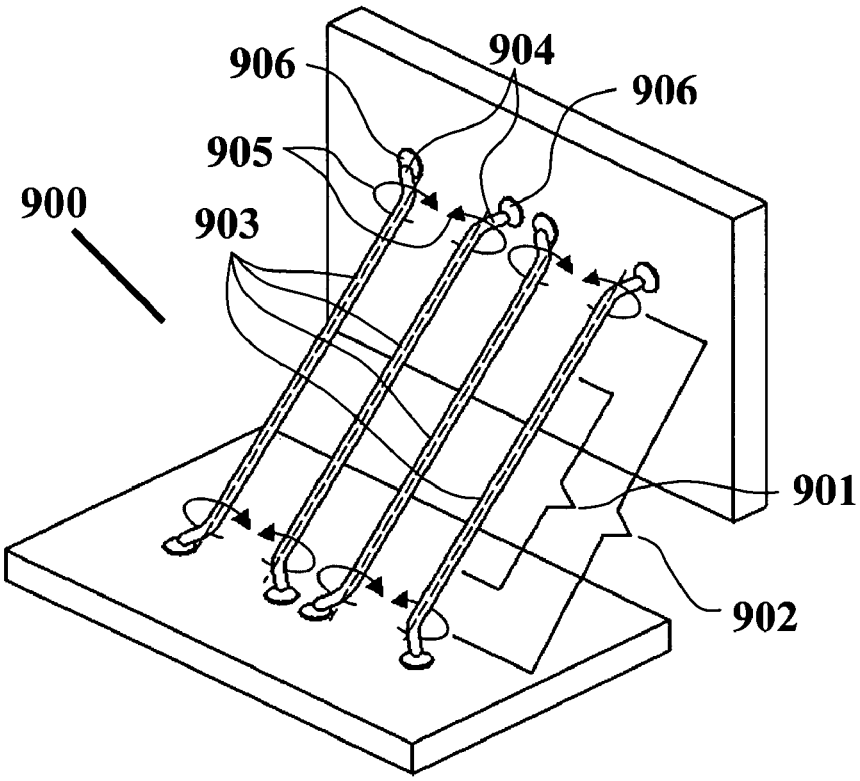
FIG. 9 illustrates an embodiment identical to FIG. 8 except that the tip sections are inclined in alternating directions.

FIG. 9 illustrates an embodiment of the electrical interconnection device in FIG. 8, in which a fixed section 901 of each of the torsion bars 902 are secured to closely conforming channels within a connector body (not shown) to prevent the torsion bar conductors 903 from freely rotating. The tip sections 904 that are adjacent to each other are inclined in opposite directions so that the sum total of their moments 905 tend to reduce the forces that may twist the body of electrical interconnection device 900 out of alignment with the electrical contact pads 906 or twist the body into an undesired shape.

Figure 10A:
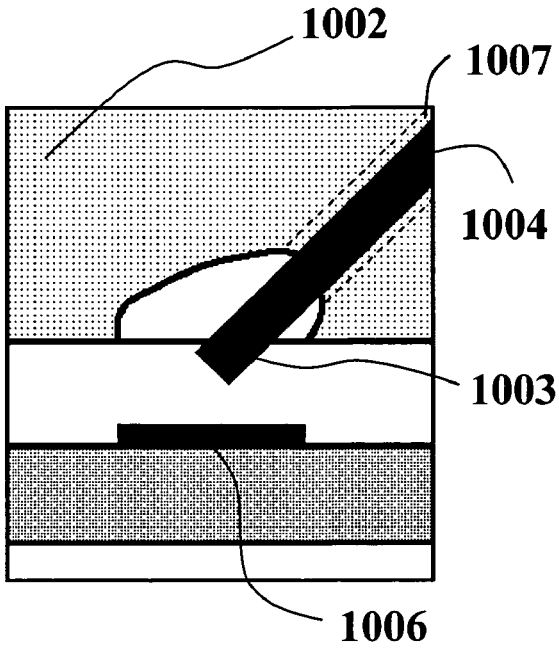
FIGS. 10*a* and 10*b* illustrate an embodiment showing a torsion bar conductor whose moment arm protrudes from the channel than others in the surrounding structure.
Figure 10B:
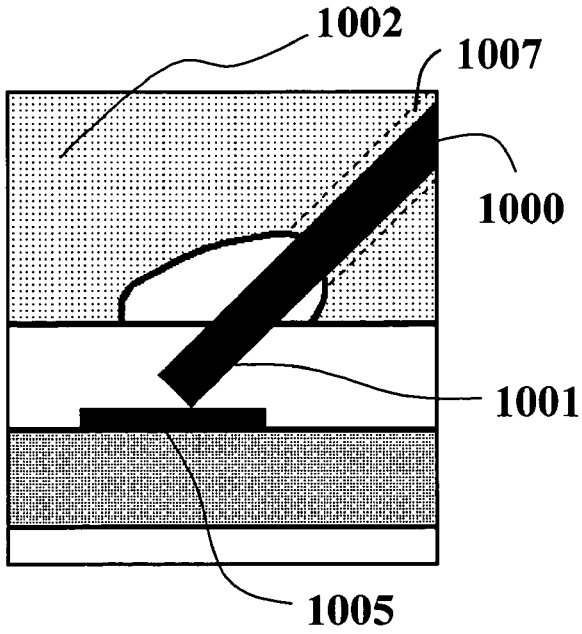

FIGS. 10A, 10B shows an embodiment of a torsion bar conductor 1000 wherein the tip section 1001 is a moment arm that protrudes farther out from the channel 1007 in the connector body 1002 of an electrical interconnection device than tip section 1003 of torsion bar conductor 1004. If conductive element 1005, 1006 are on the same surface of an electrical component such as a printed circuit board, then torsion bar conductor 1000 will contact conductive element 1005 before torsion bar conductor 1004 will contact conductive 1006. In this embodiment, one electrical signal makes electrical contact first before other signals, which may be useful, among other things, by allowing a ground to be established prior to other connections in order to protecting sensitive devices within the electrical component being interconnected.

The connector body 1002 may be molded or otherwise formed from an integral material, or may include one or more assembled components. Also, the channel 1007 may be a through-hole in the connector body 1002 or may be a cavity (i.e., extending only part way through the connector body 1002) and, in either case, may include one or more turns or angles, for example, to form a right-angle or other-angled connector. The channel 1007 may have an annular interior surface to form a cylindrical pathway or may have a polygonal interior surface (i.e., having a cross section that has three or more sides).

The connector body 1002 may be formed from a conductive material (e.g., made of conductive material or having a conductive coating) or from an insulating material (i.e., coated with or made of a material having a desired dielectric constant). Also, in the event that the connector body 1002 has a conductive surface, the conductive element 1004 may be insulated from the connector body by an insulating sheath, tube or other structure disposed within the channel 1007.

Figure 11:
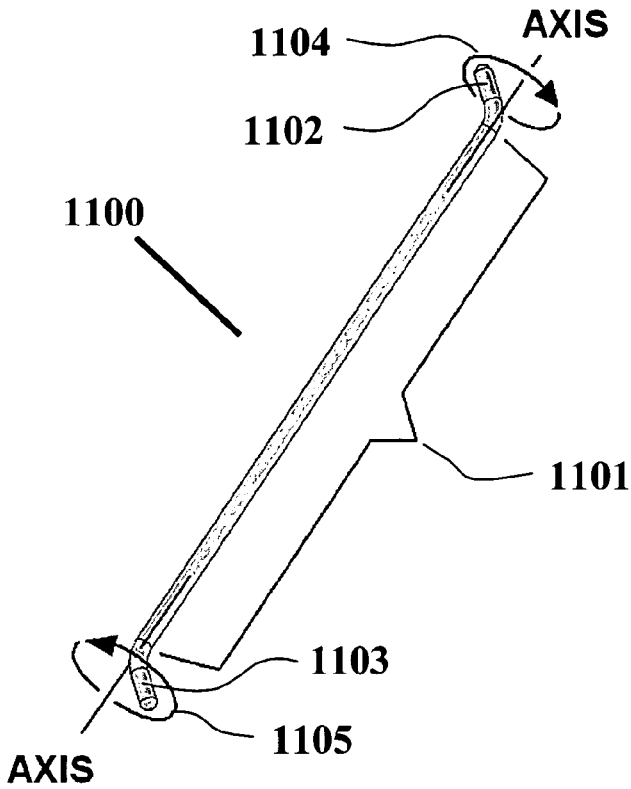
FIG. 11 illustrates an isometric view of an embodiment which is a torsion bar conductor at rest whose cylindrical axes are all in the same plane.

FIG. 11 illustrates an isometric view of an embodiment, a torsion bar conductor 1100 in which the axis of the torsion section 1101 of the torsion bar conductor 1100 and the axis of the inclined tip sections 1102, 1103 are all in the same plane. The torsion section 1101 could is contained in a closely confining channel in a structure (not shown) that allows the torsion section 1101 to twist when moments are applied to the tip sections 1102, 1103. The moment direction 1104 is the opposite of moment direction 1105. Alternatively, a fixed section could be included at the center of the torsion section 1101, holding a portion of the torsion conductor in a fixed position to prevent rotation at that point, allowing the moments applied to the tip sections to be in the same direction, yet the torsion sections would still twist to create a spring effect.

Figure 12:
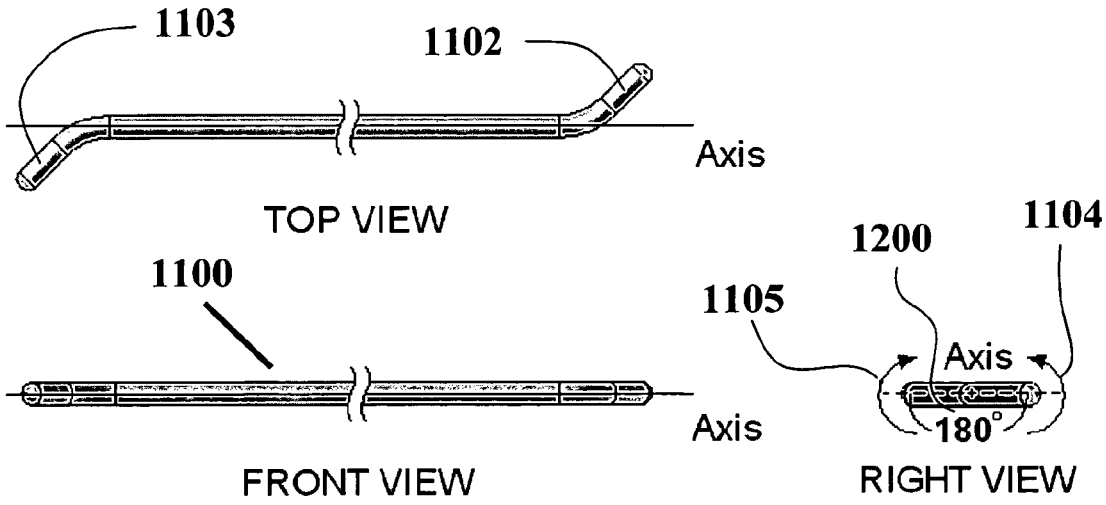
FIG. 12 illustrates orthographic top, front and right views of the torsion bar conductor in FIG. 11.

FIG. 12 further illustrates the shape of the torsion bar conductor 1100 in top, front and right views. The top view shows the tip sections included at a 45 degree angle to the torsion section. The right view shows the axes of tip section 1102, 1103 inclined at a 180 degree angle 1200 to each other.

Figure 13:
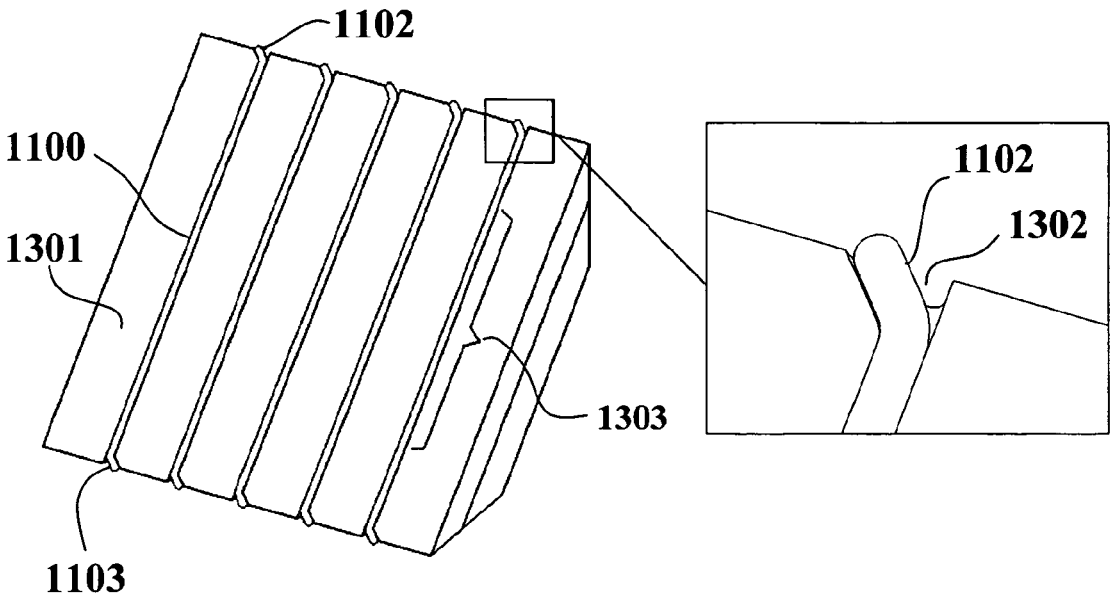
FIG. 13 illustrates an embodiment in which the torsion bar conductors shown in FIG. 11 are fitted into channels in a dielectric material layer.

FIG. 13 illustrates the torsion bar conductors 1100 shown in FIG. 11 fitted into closely conforming channels in a connector body 1301. Another dielectric layer, not shown here, that clamps over the torsion bar conductors 1100 shown in FIG. 13, has the same closely conforming channels. These two insulating layers fully enclose the conductors to form a cylindrical cavity for the conductors to rotate within. The close-up illustrates the tip section 1102 inclined at an angle to the torsion section of the conductor and the cavity 1302 through which the tip section 1102 rotates. Because the two end sections 1102, 1103 are bent at opposing angles at the ends of any torsion bar conductors 1100, the central portions 1303 of the torsion bar conductors 1100 do not necessarily have to be fixed with respect to the channel because the moments generated oppose each other, causing the torsion section 1303 to twist and creating the spring effect at the end sections 1102, 1103. However, the connector's other torsion bar conductors are longer or shorter in nearby layers. To maintain the same moment value in torsion bar conductors throughout the connector, the fixed length of the torsion section 1303 of any torsion bar conductor can be adjusted so that the moment values are always the same. To prevent the torsion bar conductors 1100 from rotating in the fixed length of the torsion section 1303, the torsion bar conductor's cross section may be made square, rectangular or some other shape that would not rotate if the enclosing channel closely conformed to that shape. The bar's fixed length of the torsion section 1303 could also be adhered to the channel using adhesives, solder or weld attachments or other mechanical restraints. The torsion bar conductors may be etched, stamped, or laser-cut from a sheet of conductive material or may be fabricated by some other method, dropped into the electrical interconnection device assembly, and then connecting bars between the conductors removed.

Figure 14:
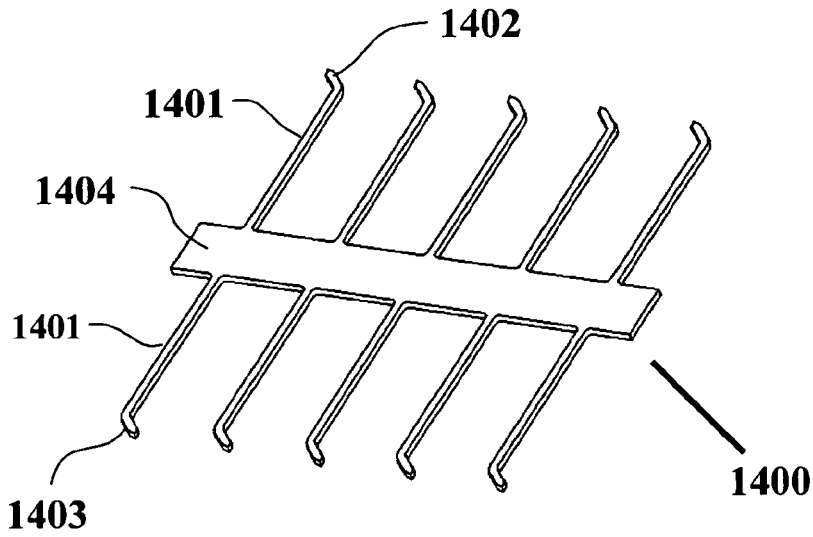
FIG. 14 illustrates an embodiment in which torsion bar conductors are an integral part of a ground plane.

FIG. 14 illustrates a torsion bar conductor ground plane 1400 wherein torsion bar conductors 1401 may be etched, stamped, or laser-cut from a sheet of conductive material or may be fabricated by some other method. The moment arms 1402, 1403 can be arranged at different angles with respect to each other as previously described in this document. The rectangular portion 1404 in the middle of the ground plane can be made larger or smaller so that the lengths of the torsion bar conductors 1401 are all of the same length if so desired. This insures that the moments of all conductors in the connector can have the same value if desired or have each conductor assigned a specific value.

Figure 15:
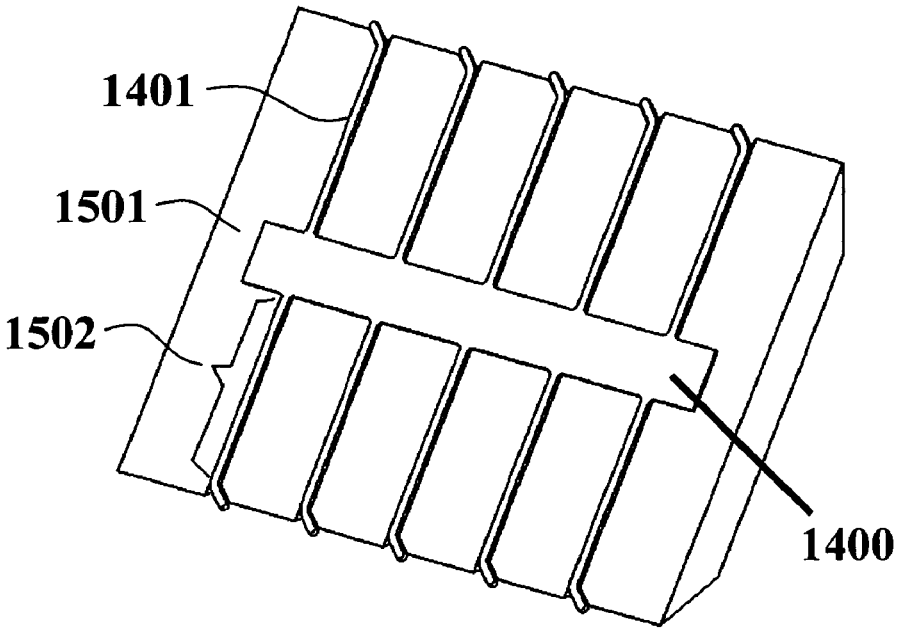
FIG. 15 illustrates the torsion bar conductor ground plane in FIG. 14 seated in a connector body.

FIG. 15 illustrates the torsion bar conductor ground plane 1400 in FIG. 14 when it is seated in a cavity within a layer 1501. The layer's material can be either conductive or insulative or the layer 1501 may be conductively coated on the surface and in the cavity under the ground plane. The layer 1501 has closely conforming channels for the torsion bar conductors 1401 to rotate within. Another layer, not shown here, clamps over the torsion bar conductors and has the same closely conforming channels thus fully enclosing all of the straight torsion sections 1502 of torsion bar conductors 1401 and permitting the conductors to rotate.

Figure 16A:
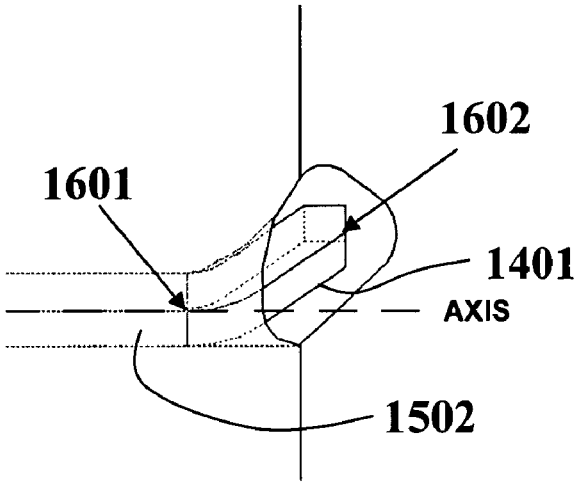
FIG. 16A illustrates a view of the moment arm of the torsion bar conductor perpendicular to its axis.
Figure 16B:
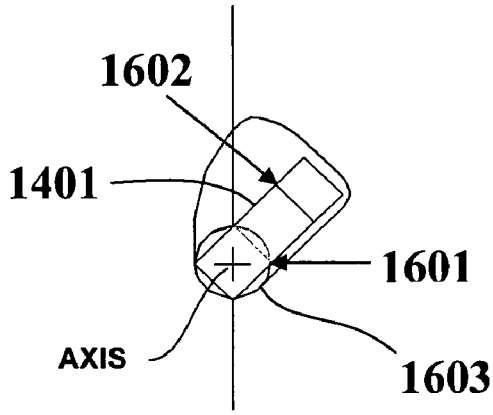
FIG. 16B illustrates a right hand view of the moment arm in FIG. 16A in the axial direction.

FIG. 16A is a view of the torsion bar conductor 1401 perpendicular to the central axis of the torsion section 1502 of the torsion bar conductor 1401. FIG. 16B is a view of the torsion bar conductor 1401 looking down the axis of the torsion section 1502 of the torsion bar conductor 1401. FIGS. 16A and 16B illustrate the point 1601 at which electrical contact is created between the torsion bar conductor 1401 and a conductive channel 1603. The point 1602 is the electrical contact point between the torsion bar conductor 1401 and the electrical contact pad, not shown, of the printed circuit board. The arrows in each view point to the electrical contact points. FIGS. 16A and 16B illustrate the short current path between point 1601 and 1602.

Figure 17:
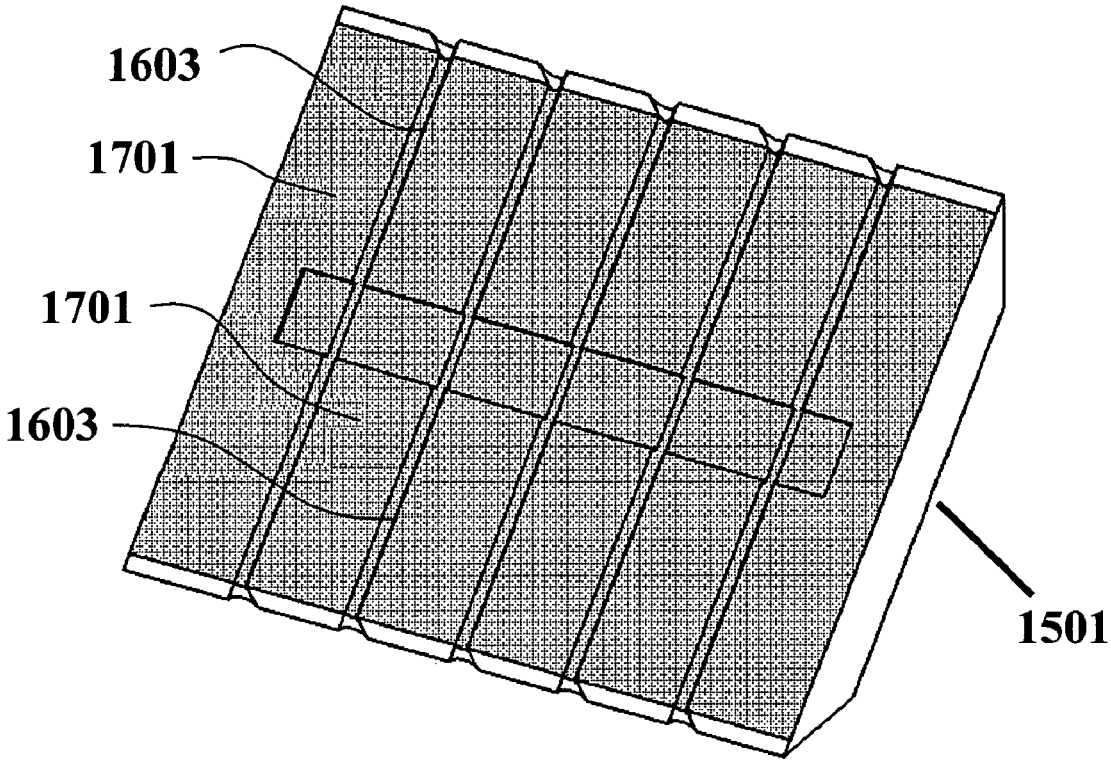
FIG. 17 illustrates a perspective view of the connector body in FIG. 15 with conductive coating on the planar surface and the cylindrical channels.

FIG. 17 illustrates a layer 1501 in which half of the channel 1603 and the planar surface 1701 identified by the shading in the figure, are conductively coated and are a continuous entity. When combined with the torsion bar conductor ground plane 1400, the combination acts as ground plane for a transmission line structures. The current path could flow directly through point 1601, in FIG. 16, into the ground plane thereby decreasing inductive signal discontinuities and helping to maintain the uniformity of the transmission line's electromagnetic field.

Figure 18:
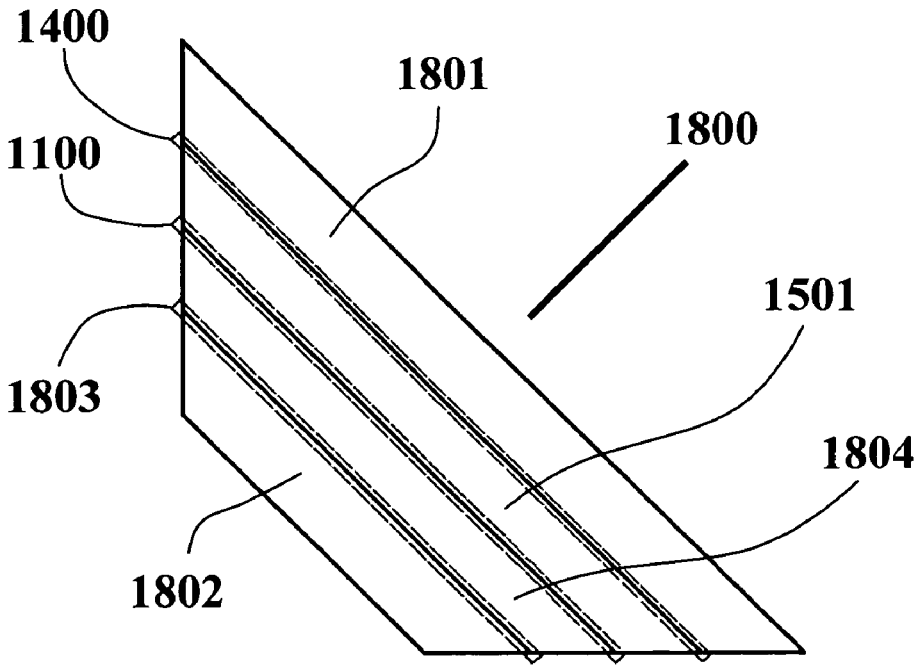
FIG. 18 illustrates a side view of an embodiment, an electrical connector whose connector body includes dielectric layers that capture two torsion bar conductor ground planes above and below a row of individual torsion bar conductors.

FIG. 18 illustrates a side view of the electrical connector 1800 wherein dielectric layer 1501 with a conductive coating on the upper surface and a similar dielectric layer 1801 with a conductive coating on the lower surface enclose torsion bar conductor ground plane 1400. Torsion bar conductor ground plane 1803 is enclosed in a similar manner by dielectric layers 1802 and 1804. Torsion bar conductors 1100 are enclosed by dielectric layers 1501 and 1804, whose lower and upper surfaces are not conductively coated.

Figure 19:
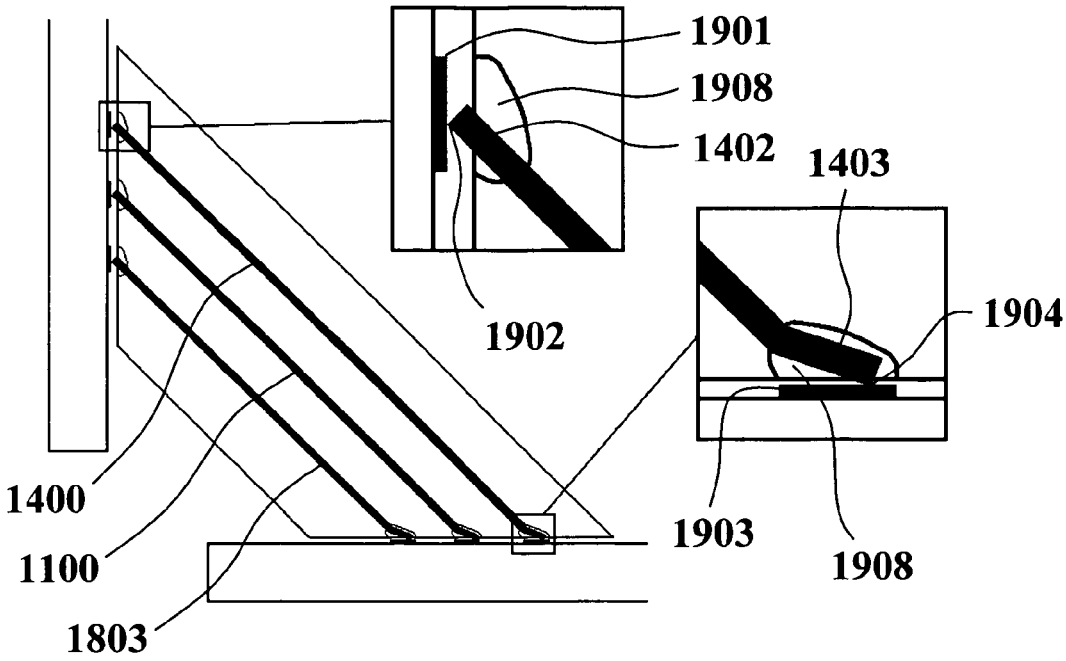
FIG. 19 illustrates a cross section of the embodiment in FIG. 18.

FIG. 19 illustrates a cross section through the electric connector 1800 in FIG. 18. The close-up at the top of the figure shows the printed circuit board's electrical contact pads 1901 beginning to touch the torsion bar conductors' electrical contacts 1902. The close-up on the right illustrates the printed circuit board's electrical contact pads 1903 when they are fully mated with the torsion bar conductors' electrical contacts 1904. The torsion bar conductor 1100 is a signal path with torsion bar conductor ground planes 1400, 1803 above and below it respectively. The figure illustrates the small feature sizes of the moment arms 1402, 1403 and corresponding small cavities 1908 through which the moment arms 1402, 1403 rotate. These moment arms and cavities can be made very small and as they become smaller, they disturb the impedances of the connector's transmission line geometries at higher and higher frequencies in comparison to the prior art.

Figure 20:
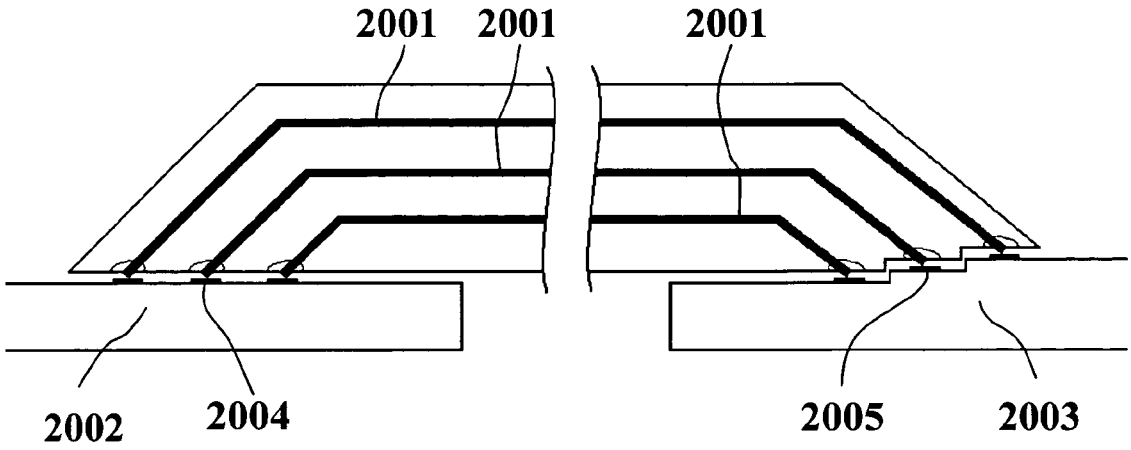
FIG. 20 illustrates an embodiment wherein printed circuit boards are connected utilizing torsion bar elements, and the printed circuit boards are disposed at 180 degrees to each other.

FIG. 20 illustrates an embodiment, the electrical connector in FIG. 19 wherein the printed circuit boards can be disposed at 180 degrees or some other angle to each other and at any distance from each other. The distance between the electrical connector's torsion bar conductors 2001 are maintained so that the signal integrity and impedance of the transmission line is uniform throughout the connector if desired. The printed circuit board 2002 at the lower left has all the electrical contact pads 2004 at the top surface. The printed circuit board 2003 on the lower right has a stair step configuration in which the rows of electrical contact pads 2005 are on different surfaces of the stair step. FIG. 20 also illustrates how signal integrity discontinuities are kept to a minimum by keeping the moment arms and surrounding cavities small relative to other prior art electrical connectors.

Figure 21:
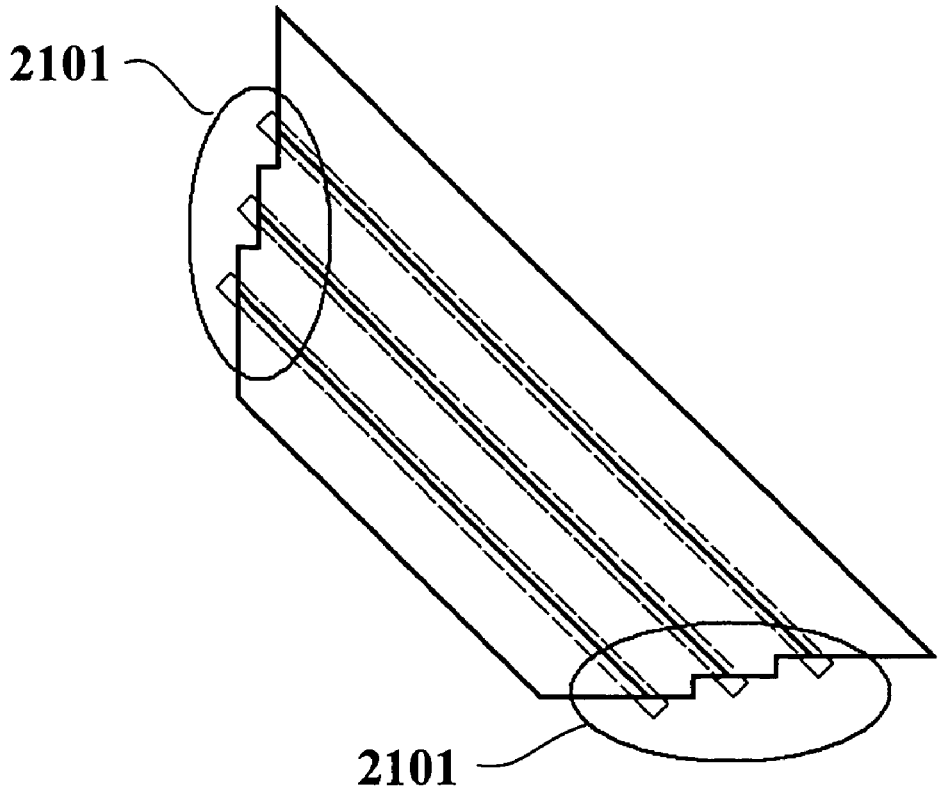
FIG. 21 illustrates the same side view as in FIG. 18 except that the electrical contact rows are arrayed in a stair step configuration.

FIG. 21 illustrates how the electrical connector's electrical contact rows shown in FIG. 18 may be adapted into a stair step configuration 2101 so they may interface with rows of electrical contact pads on stair step printed circuit boards. Although FIG. 21 implies that the printed circuit boards are at 90 degrees to each other, they may be at other angles.

Figure 22:
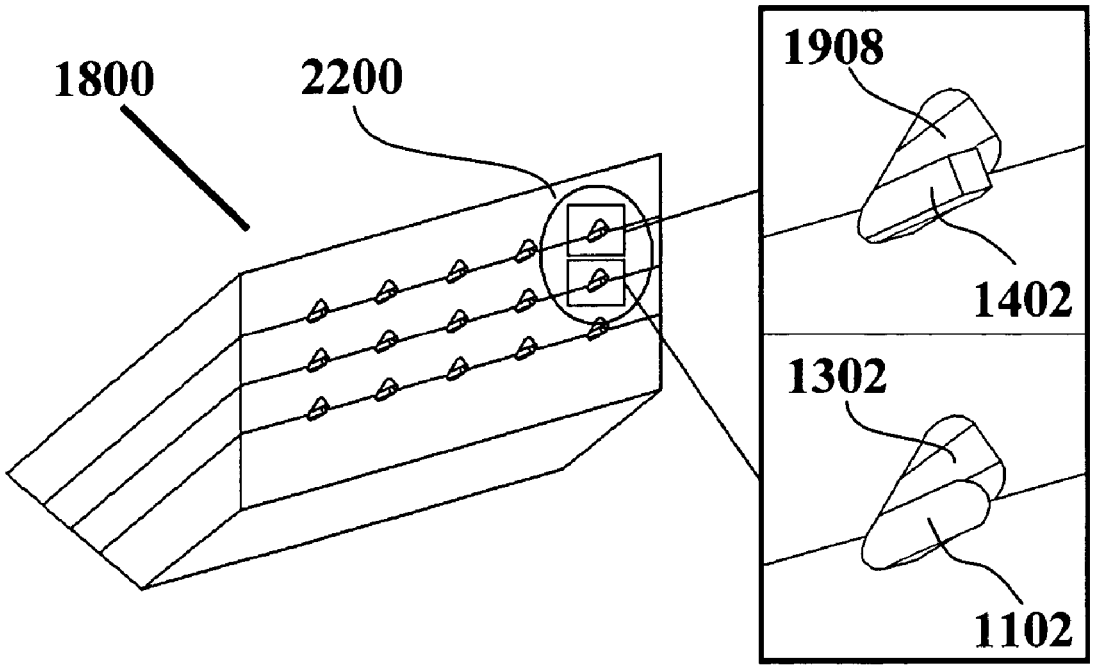
FIG. 22 illustrates the interconnect face of the electrical connector in FIG. 19 showing an array of torsion bar conductors' electrical contacts.

FIG. 22 further clarifies FIG. 21 by showing the electrical connector's moment arms 1102, 1402 in an isometric view 2200 in which the close-up at top right shows moment arm 1402 protruding through cavity 1908 and the close-up at bottom right shows moment arm 1102 protruding through cavity 1302.

Figure 23A:
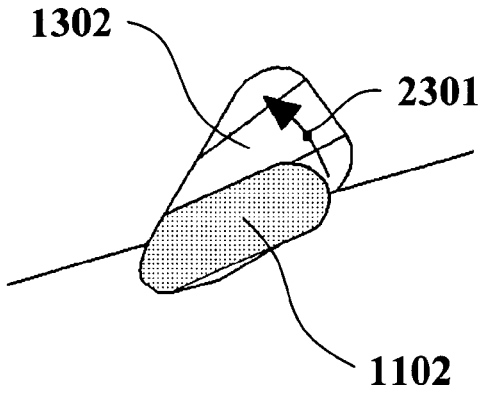
FIG. 23A illustrates an enlarged view of the electrical contact in FIG. 22 when it is in the unmated condition.
Figure 23B:
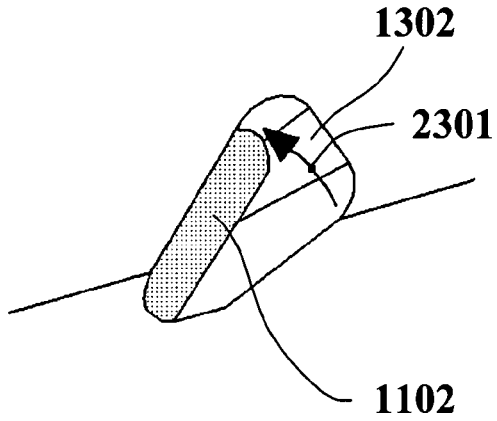
FIG. 23B illustrates an enlarged view of the electrical contact in FIG. 23A when it is in the fully mated condition.

FIG. 23A illustrates the moment arm 1102 protruding through cavity 1302. The arrow 2301 shows the direction through which the moment arm 1102 rotates as the printed circuit board's electrical contact pad (not shown) mates with the electrical connector 1800. FIG. 23B shows the moment arm's final position as it withdraws into the cavity 1302 and the electrical connector 1800 has fully mated with the printed circuit board.

Figure 24:
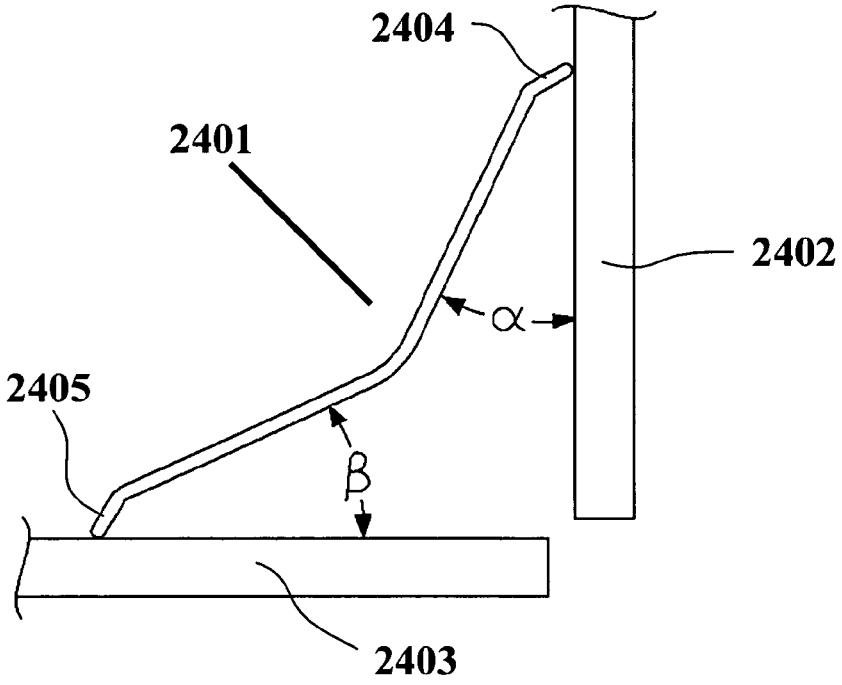
FIG. 24 illustrates an embodiment in which a torsion bar conductor incorporates a bend in its central portion.

FIG. 24 illustrates that either end of the torsion bar conductor 2401 can be inclined at different angles $\alpha$ or $\beta$ with respect to the printed circuit boards 2402, 2403 by bending the torsion bar conductor 2401 within its torsion section. The angles $\alpha$ or $\beta$ can include an orientation of the torsion bar conductor 2401 wherein its torsion section is closer to or farther away from the viewer than its moment arms 2404, 2405. Thus the torsion bar conductor 2401 does not have to be straight in order to operate. Any of the angles $\alpha$ or $\beta$ in FIG. 24 may be changed to obtain different property values including contact forces, direction of contact wipe, contact location or connector size and shape.

Figure 25:
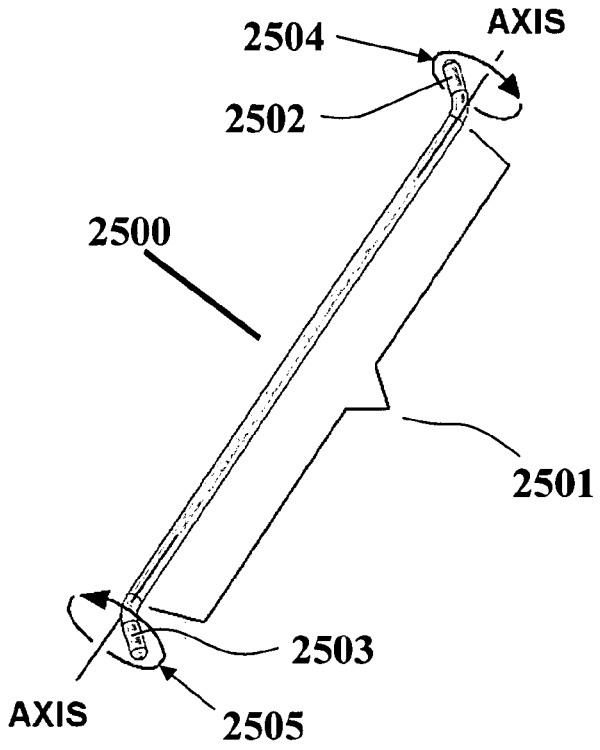
FIG. 25 illustrates an embodiment in which a torsion bar conductor's axes are bent out of plane.
Figure 26:
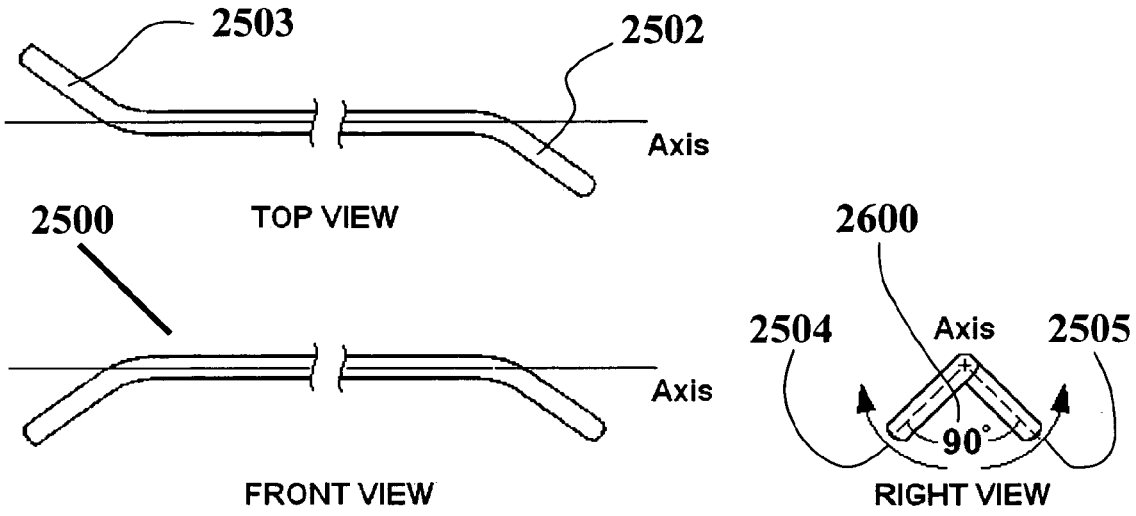
FIG. 26 illustrates orthographic top, front and right views of the torsion bar conductor in FIG. 25.

FIGS. 25 and 26 illustrate another torsion bar conductor configuration useful for incorporation into an embodiment, a flat or stair step connector as shown in FIGS. 27 through 30. FIG. 25 illustrates a torsion bar conductor 2500 similar to the torsion bar conductor 1100 in FIG. 11 except that the moment arms 2502, 2503 are bent downward with respect to the axis of the torsion bar conductor's torsion section 2501. The moment arms 2502, 2503 rotate in the same directions 2504, 2505 as the moment arms in FIG. 11.

FIG. 26 further clarifies the shape of the torsion bar conductor 2500 in top, front and right views. In the right view, the axes of the moment arms 2502, 2503 are generally at but not limited to a 90 degree angle 2600 to each other. The arrows indicate their direction of twisting action 2504, 2505 when the torsion bar conductor 2500 is pressed down upon electrical contact pads whose surfaces are generally in the same plane.

Figure 27:
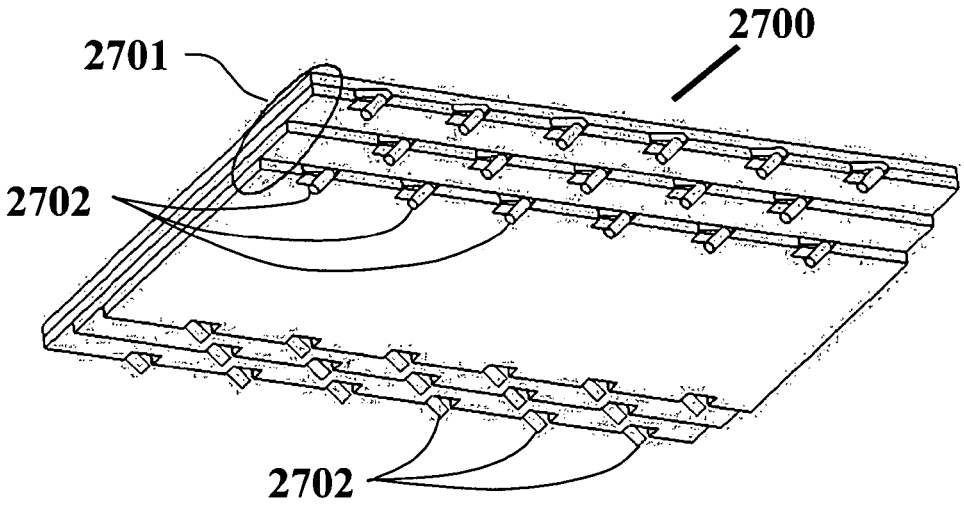
FIG. 27 illustrates an embodiment with stair step rows of torsion bar conductor electrical contacts.
Figure 28:
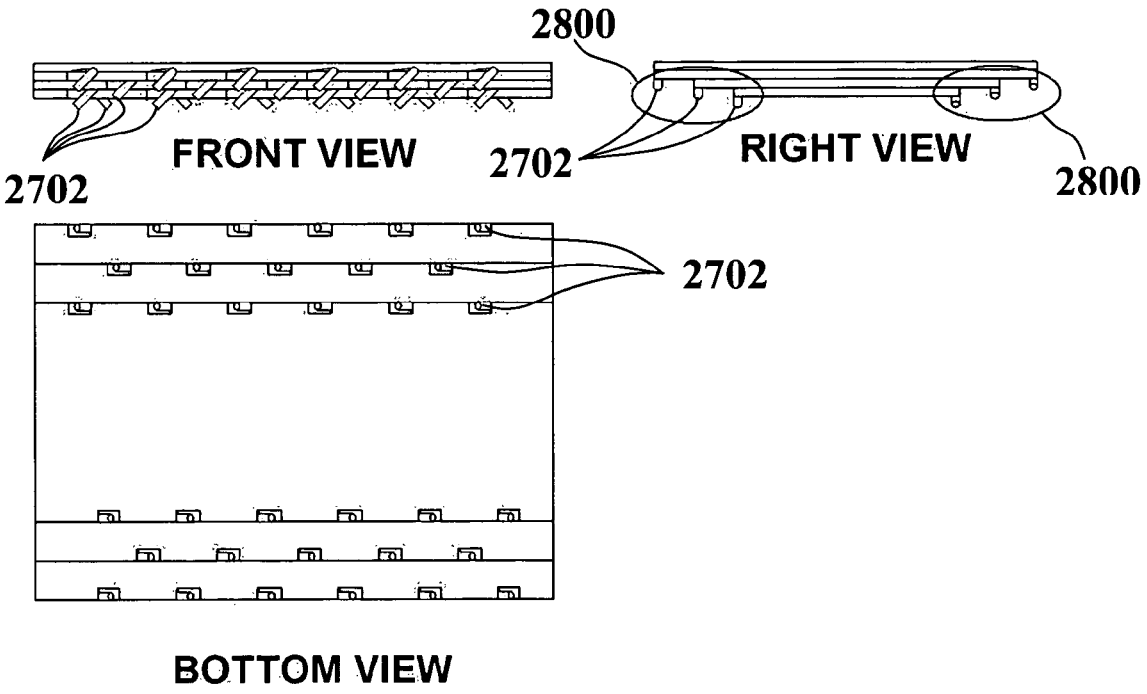
FIG. 28 illustrates orthographic front, right and bottom views of FIG. 27.
Figure 29:
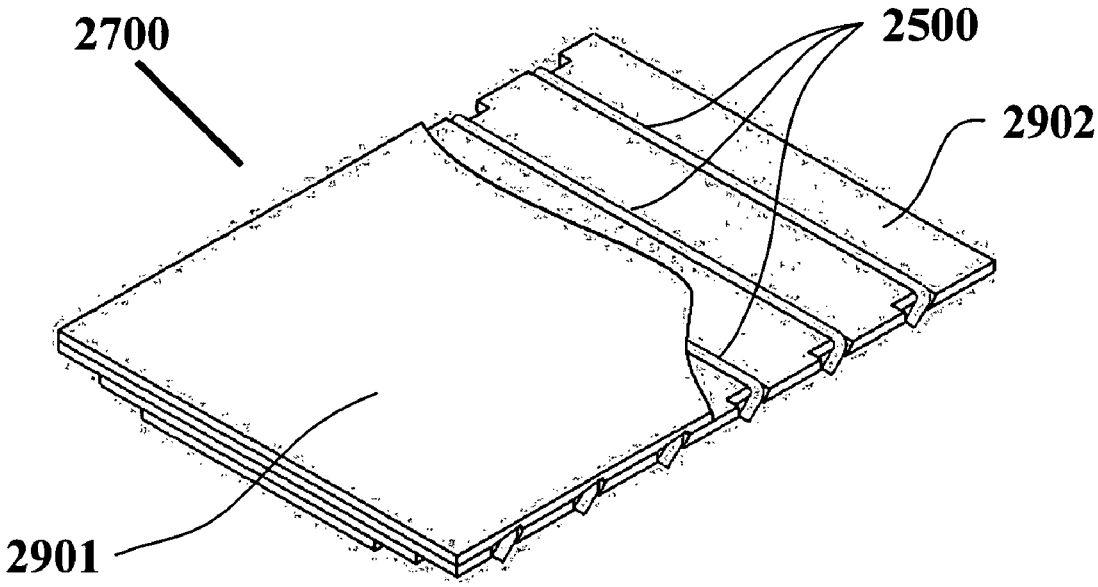
FIG. 29 illustrates a top isometric view of the embodiment in FIG. 27 with a portion of the top insulating layer removed to show the torsion bar conductors.

FIGS. 27 through 29 illustrate an embodiment, an electrical connector 2700 with a stair step configuration 2701 whose rows of electrical contacts 2702 can interface with corresponding rows of electrical contact pads on electrical components such as stair step printed circuit boards (not shown). The electrical connector 2700 uses the torsion bar conductors 2500. The center portion of the torsion bar conductors may be replaced by and be conductively attached to conductive entities such as etched signal traces of a flexible circuit, wires in a cable or coaxial structures in a coaxial cable. These conductive entities may have various lengths and curvatures allowing the electrical interconnection of distantly placed electrical components.

FIG. 28 further clarifies the electrical connector 2700 in FIG. 27 by showing front, bottom and right views. The right view shows the stair step configuration 2800 of the rows of electrical contacts 2702.

In FIG. 29, the top dielectric layer 2901 of electrical connector 2700 is partially sectioned to show the torsion bar conductors 2800. The torsion bar conductors 2500 captured by closely conforming channels in the bottom surface of top layer 2901 and closely conforming channels in the top surface of the second dielectric layer 2902.

Figure 30:
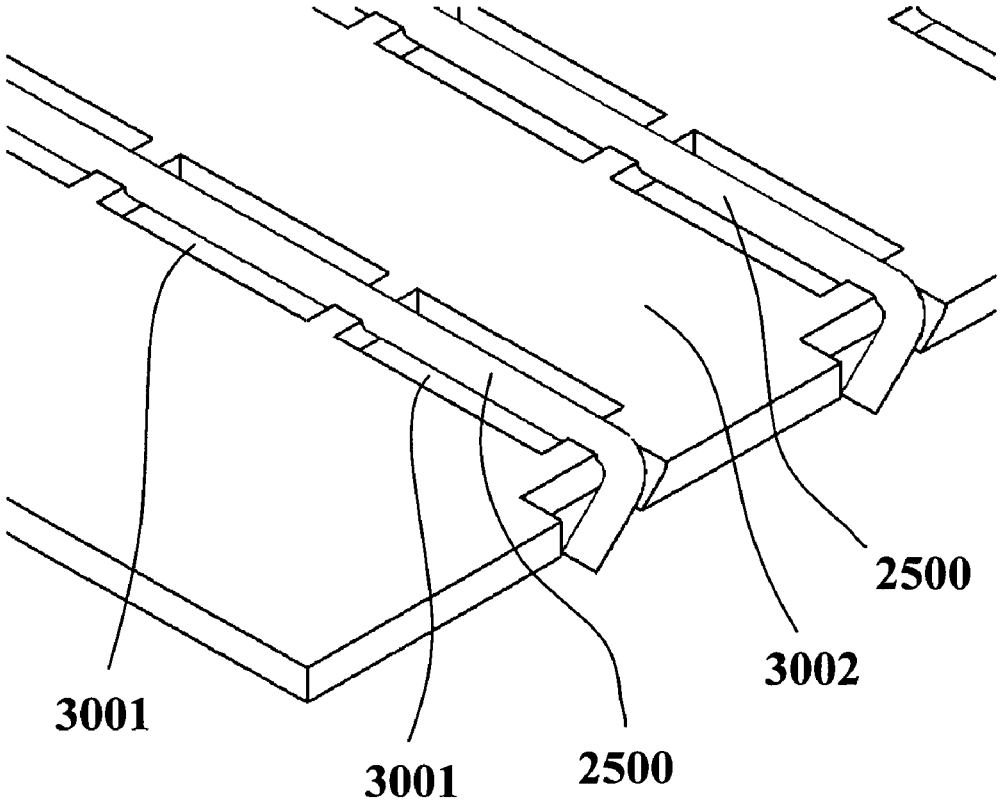
FIG. 30 illustrates an embodiment of the invention in FIG. 29 except with air cavities in the dielectric layer underneath the conductors.

FIG. 30 illustrates how cavities 3001 are placed within the second dielectric layer 3002 or any dielectric layer and underneath the torsion bar conductors 2500 to reduce the relative dielectric constant and increase the signal's propagation velocity. The cavities 3001 may be filled with air, dielectric foam or a dielectric with a relative dielectric constant whose value is lower than that of the material surrounding the cavities.

Figure 31:
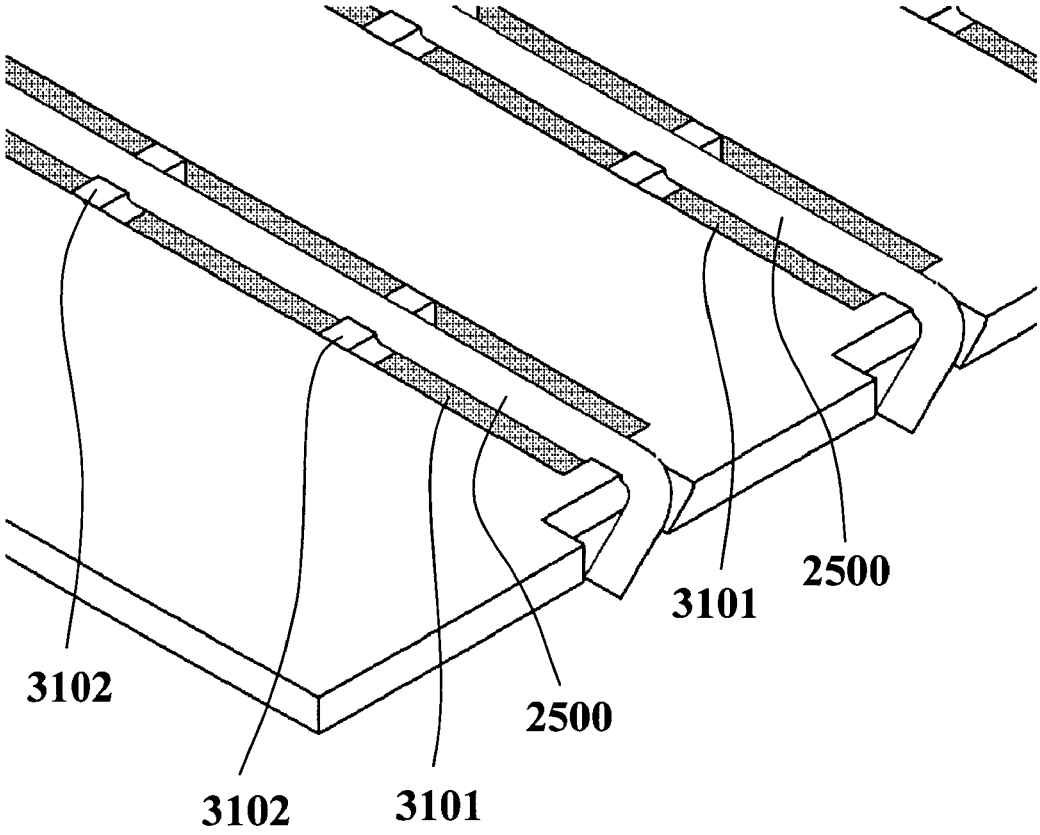
FIG. 31 illustrates the torsion bar conductor in FIG. 30 with the surfaces of the cavities conductively coated and insulated spacers supporting the conductors.

FIG. 31 illustrates the torsion bar conductor 2500 supported by insulated channel spacers 3102 in cavities 3101. The cavities 3101 may be filled with air, dielectric foam or a dielectric with a relative dielectric constant whose value is lower than that of the material surrounding the cavities. The walls of the cavities 3101 can be conductively coated, as illustrated by shading, to create a ground return path. The ground return path and the torsion bar conductor 2500 create a waveguide such as a coaxial transmission line. The cavities 3101 lower the effective dielectric constant and increase the signal's propagation velocity.

Figure 32:
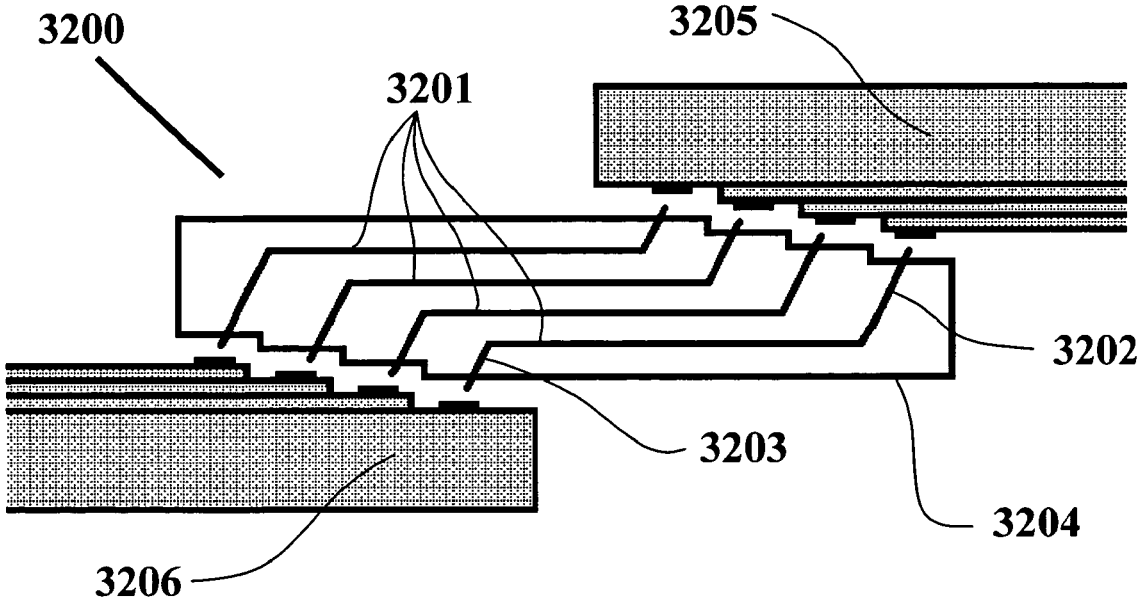
FIG. 32 illustrates the use of torsion bar conductors that connect printed circuit boards oriented 180 degrees to each other and whose electrical contact pads are opposite each other.

FIG. 32 is another embodiment, an electrical connector 3200 similar to the electrical connector 2700 in FIG. 27 except that the moment arms 3202, 3203 of the torsion bar conductors 3201 protrude through the bottom and top surfaces of the connector body 3204. The rows of electrical contacts formed by the moment arms 3202, 3203 are in a stair step configuration to match the electrical contact pads on the stair step printed circuit boards 3205, 3206 whose electrical contact pads are opposite each other.

Figure 33:
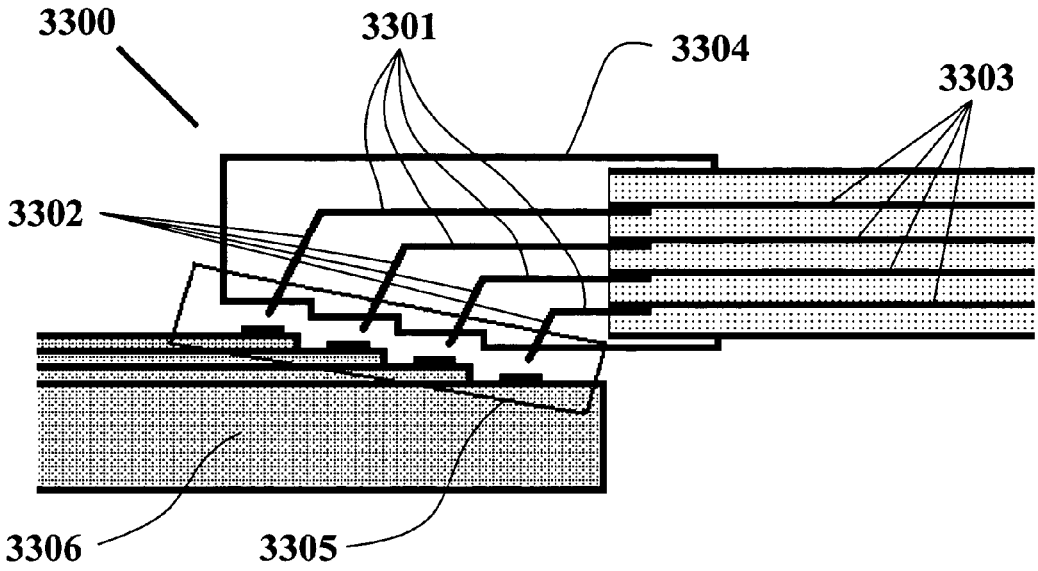
FIG. 33 illustrates the torsion bar conductors that are an extension of signal traces in a flexible circuit or of wires in a cable.

FIG. 33 is an embodiment, an electrical connector 3300 wherein the torsion bar conductors 3301 are attached to, or are an extension of conductive entities 3303 such as etched signal traces of a flexible circuit, wires in a cable or coaxial structures in a coaxial cable. The rows of electrical contacts at the ends of the moment arms 3302 protrude downward through the bottom surface of the connector body 3304 in a stair step configuration 3305. The electrical connector 3300 mates with the electrical contact pads on the stair step printed circuit board 3306.

Figure 34:
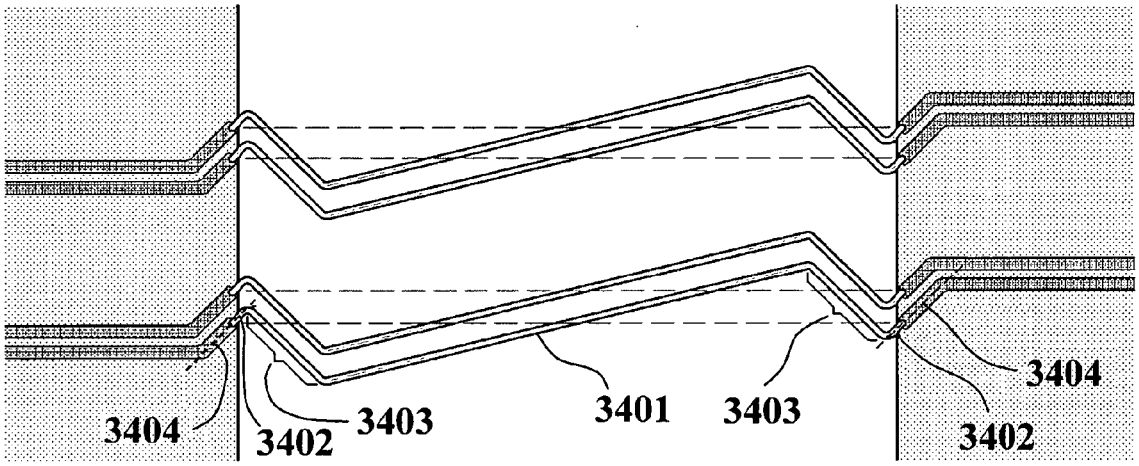
FIG. 34 illustrates the torsion bar conductors bent at an angle so that the contact wipe is in the direction of the signal traces on the printed circuit board.

FIG. 34 is an embodiment shown in FIG. 27. FIG. 34 illustrates how the normally straight sections of torsion bar conductors 3401 can be bent at various angles. This allows the moment arms 3402 to rotate in a plane coincident with the axes of aligned electrical contact pads 3404 of printed circuit boards. Thus the contact wipe created by this action is in the same direction as the axes 3404 of the electrical contact pads on the printed circuit board. In previously shown embodiments of the invention, the electrical contact pads had to be widened to accommodate the torsion bar conductors' contact wipe that was perpendicular to the torsion section of the torsion bar conductor and the axes of the signal traces. An electrical contact pad whose perimeter is at abrupt right angles to the signal trace decreases signal integrity. In addition, FIG. 34 shows how the torsion bar's length 3403 is kept equal in each torsion bar conductor and shorter than the overall length of the torsion bar conductor. The latter is done to insure that the contact force or moment value is kept the same from conductor to conductor and at either end of any torsion bar conductor.

Figure 35:
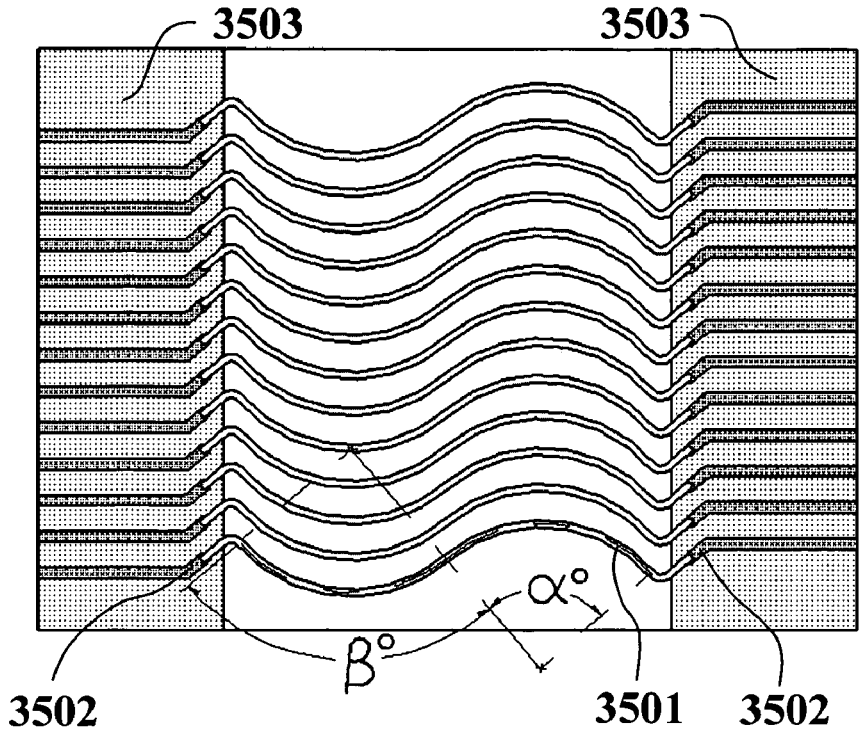
FIG. 35 illustrates the curved torsion bar conductors in closely fitted channels.

FIG. 35 illustrates another embodiment wherein the torsion bar conductors 3501 are curved rather than straight. The torsion bar conductors 3501 are inside closely conforming channels that confine the curved portion of the torsion bar conductors 3501 but allow them to rotate. The contact wipe is in the direction of the axes of signal traces 3502 on the printed circuit boards 3503 and provides the same improved signal integrity as in FIG. 34. This configuration allows increase electrical contact density.

Figure 36:
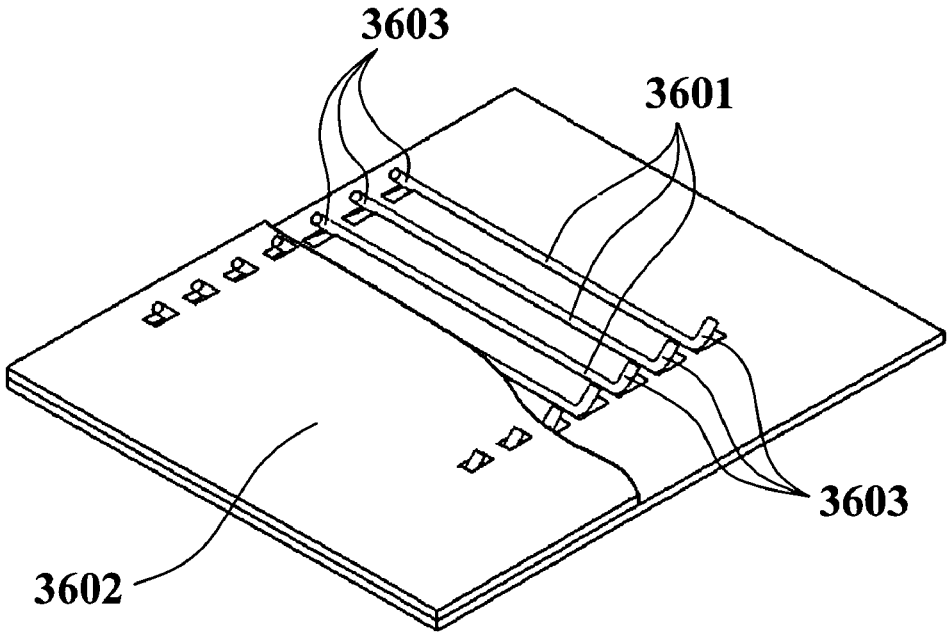
FIG. 36 illustrates the torsion bar conductors embedded inside a printed circuit board such as a backplane with a portion of the top PCB layer removed to show the torsion bar conductors.

FIG. 36 illustrates an embodiment, electrical interconnection device in which the torsion bar conductors 3601 are embedded inside the layers of a printed circuit board 3602. FIG. 36 shows the printed circuit board's top layer sectioned to show the torsion bar conductors 3601 underneath. The central portion of torsion bar conductors 3601 may be replaced by flexible conductive wires, center conductors inside coaxial cable or the like or a combination of them. Any of the latter structures or the central portion of torsion bar conductors 3601 may be routed in varying directions and with different bends on one layer, and if needed, may be dropped down to another layer. Etched copper traces may also take the place of the previously mentioned conductive wires. In such a manner, signals may be routed from one layer of the printed circuit board to another.

Figure 37:
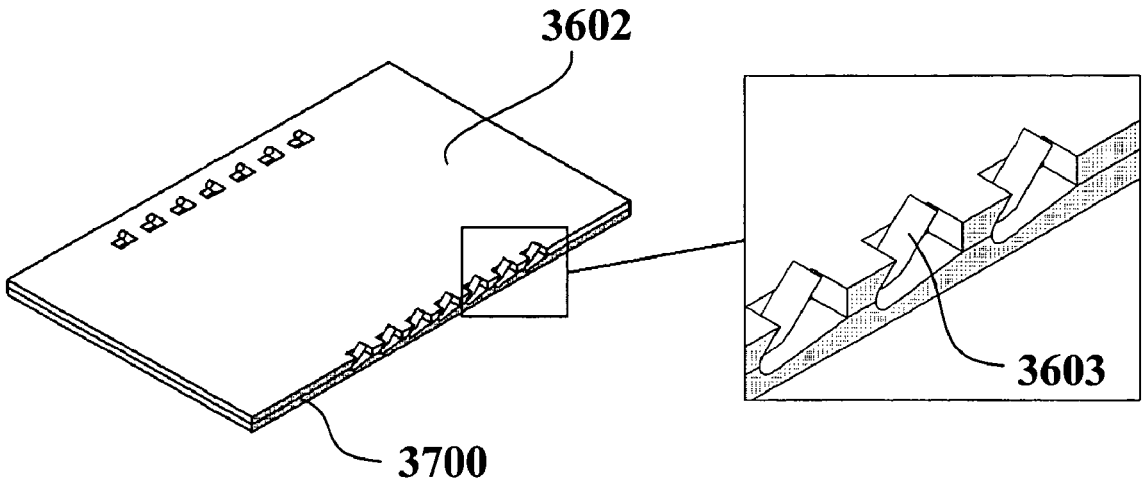
FIG. 37 illustrates a cross section of FIG. 36 showing the opening surrounding the moment arms of the torsion bar conductors used as signal or power buses.

FIG. 37 is a cross section 3700 of FIG. 36 showing the tip sections 3603 in their cavities.

Figure 38:
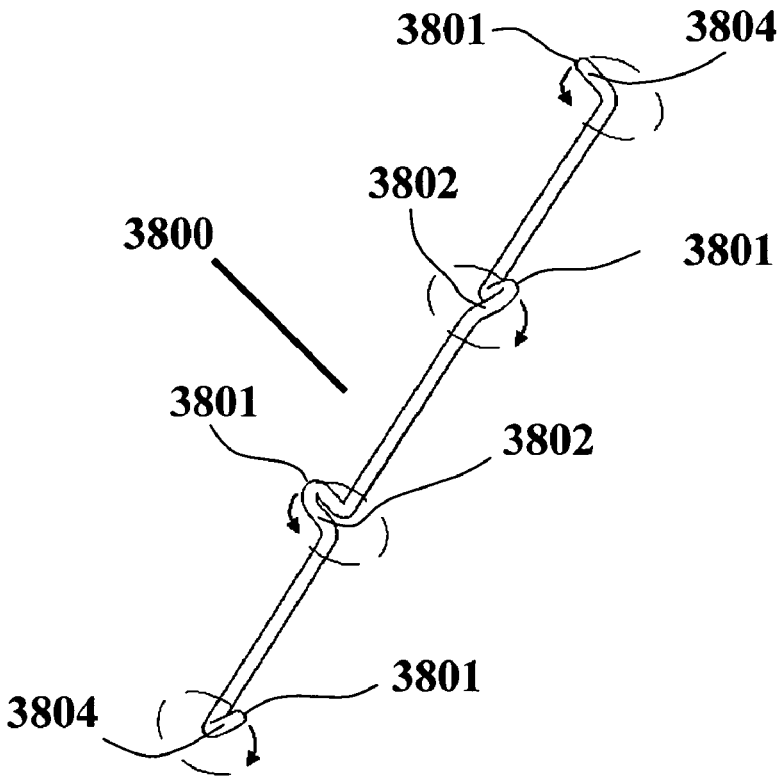
FIG. 38 illustrates a single torsion bar conductor with several electrical contact points.

FIG. 38 illustrates another embodiment, a torsion bar conductor 3800 with multiple electrical contacts 3801 at the ends of projections 3802 and at tip sections 3804. As shown, the projections 3802 may be formed by bends (three bends are shown in FIG. 38) in the torsion bar conductor 3800, though other structures may be used to form the projections in alternative embodiments.

Figure 39:
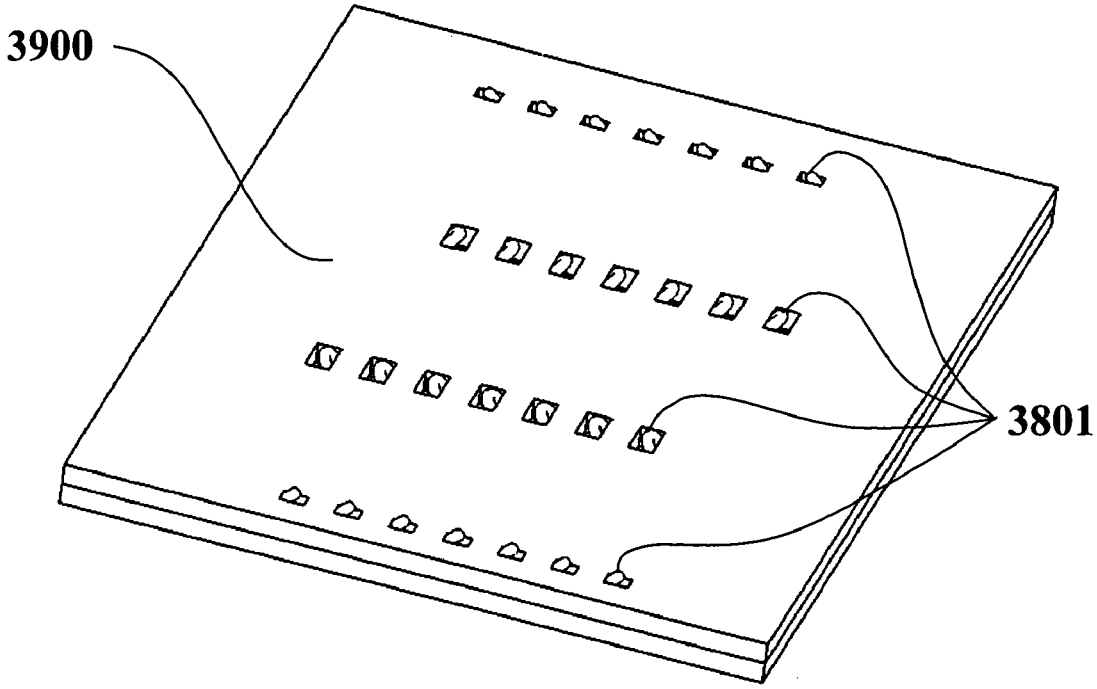
FIG. 39 illustrates the multiple-contact torsion bar conductors used in a bus configuration within a printed circuit board.

In FIG. 39, the torsion bar conductors 3800 are embedded inside the layers of a printed circuit board 3900 for use as a signal or power bus connector. The multiple electrical contact points 3801 allow the same signal to be accessible at several places on the printed circuit board 3900.

Figure 40:
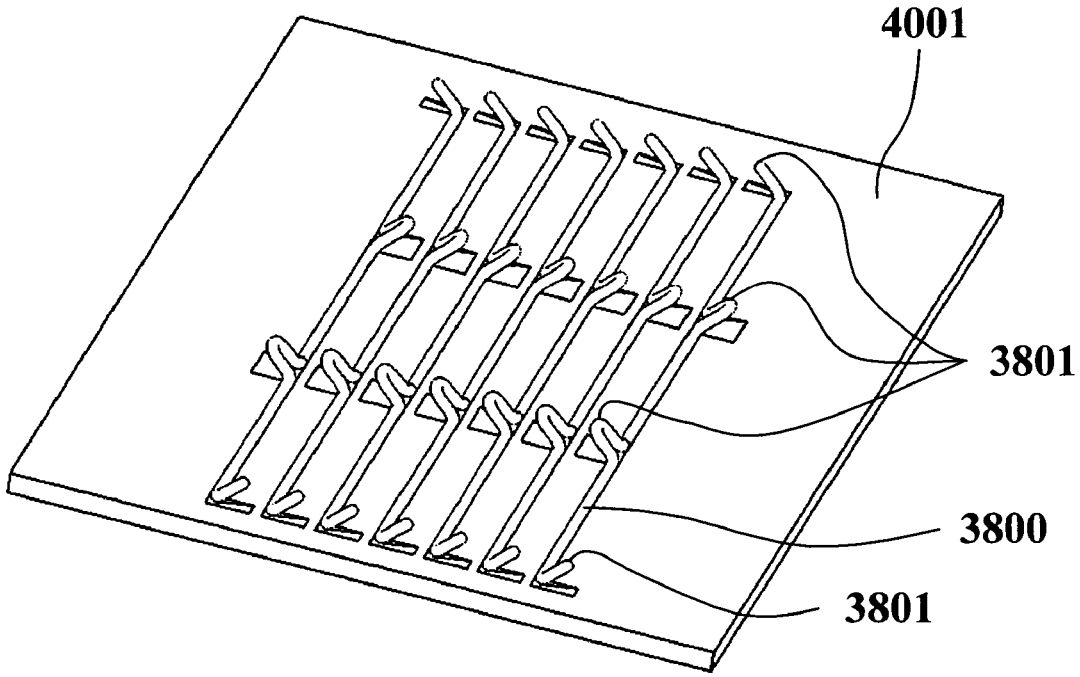
FIG. 40 illustrates the bus configuration in FIG. 39 with the top PCB layer removed to show the multiple-contact torsion bar conductors.

FIG. 40 illustrates the bus connector with the top layer of the printed circuit board 3900 removed to show the location and orientation of the torsion bar conductors 3800, which are confined by channels in the bottom layer 4001 of the printed circuit board. One torsion bar conductor 3800 has multiple electrical contacts 3801 and the torsion bar conductors' geometry creates contact force for each electrical contact.

Figure 41:
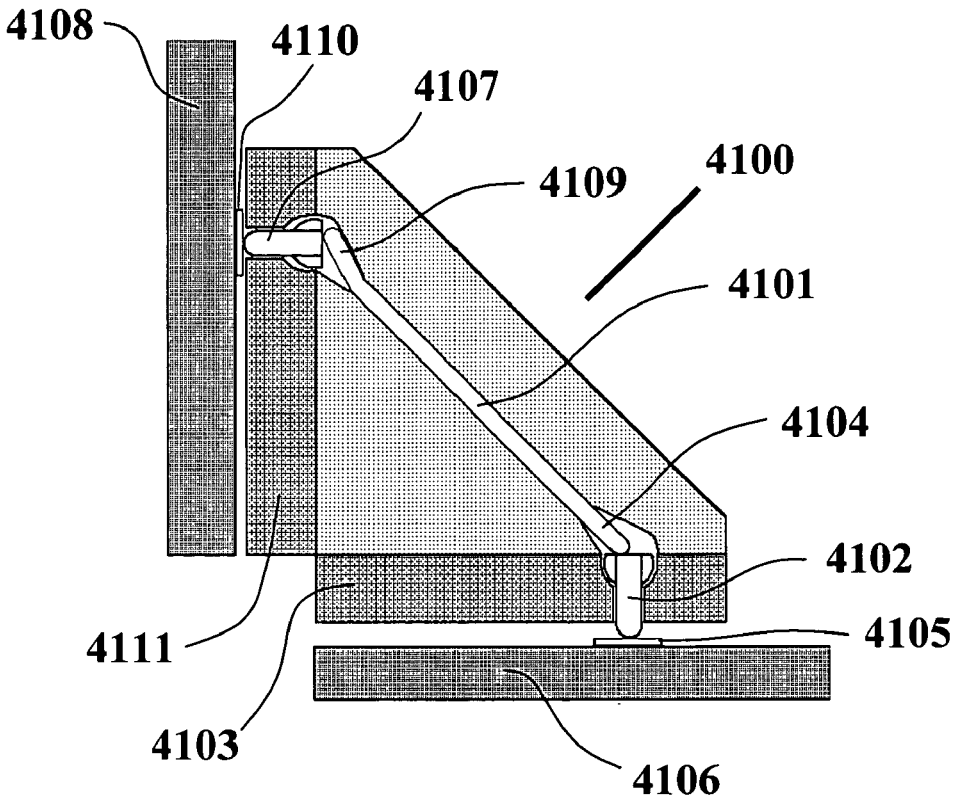
FIG. 41 illustrates an embodiment showing how a push pin is combined with the torsion bar conductors with the left PCB mated and the bottom PCB in an unmated condition.

FIG. 41 illustrates another embodiment, an electrical connector 4100 wherein push pins 4102, 4107 are combined with the torsion bar conductor 4101. When the electrical connector is unmated, the electrical contact pad 4105 on printed circuit board 4106 is shown just as it touches push pin 4102. In this condition, the tip section 4104 has driven the push pin 4102 downward so that it fully protrudes through a hole in the locating plate 4103. When the electrical connector 4100 is mated, the electrical contact pad 4110 of the printed circuit board 4108 urges the push pin 4107 farther into the hole of the locating plate 4111 and places force on tip section 4109. When tip section 4109 is fully actuated, it creates an electrical connection between the contact pad 4110 and push pin 4107 and between push pin 4107 and torsion bar conductor 4101.

Figure 42:
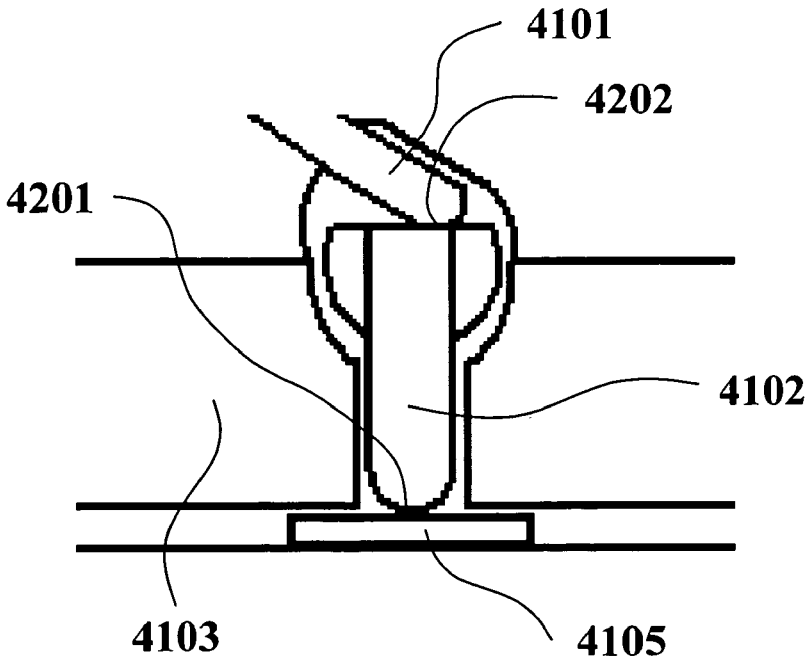
FIG. 42 illustrates an enlarged view of the pin and torsion bar conductor's moment arm in FIG. 41 in its mated condition.

FIG. 42 is a close-up view of the push pins 4102 in FIG. 41. As contact pitches grow smaller, it becomes harder to align the connector's electrical contacts 4202 on torsion bar conductors 4101 to the electrical contact pads 4105 on the printed circuit boards. Push pins 4102 provide an additional opportunity for alignment. If the diameters of the push pins 4102 and their enclosing holes are fabricated with small tolerances, movement of the push pins' axes will be limited. To provide contact wipe between the push pins 4102 and electrical contact pads 4105, the pin can be made to twist about its central axis. A broach with a twist in it can be used to fabricate the holes in the locating plates 4103. Or the twist may be molded into the locating plate's holes or may be fabricated by some other method. The push pin could have one or more protrusions or bumps on its outer surface that follows the resulting twist feature on the hole's cylindrical surface. The protrusions or bumps may be fabricated of an insulating material to provide better signal integrity. An alternative embodiment is to reverse the features and place the twist feature on the pin or the pin's insulating collar and the bump or bumps on the hole's cylindrical surface. The twist feature may also be manipulated by changing the thread pitch. Another alternative embodiment places external threads on the push pin and internal threads on the diameter of the holes in the locating plate.

Figure 43:
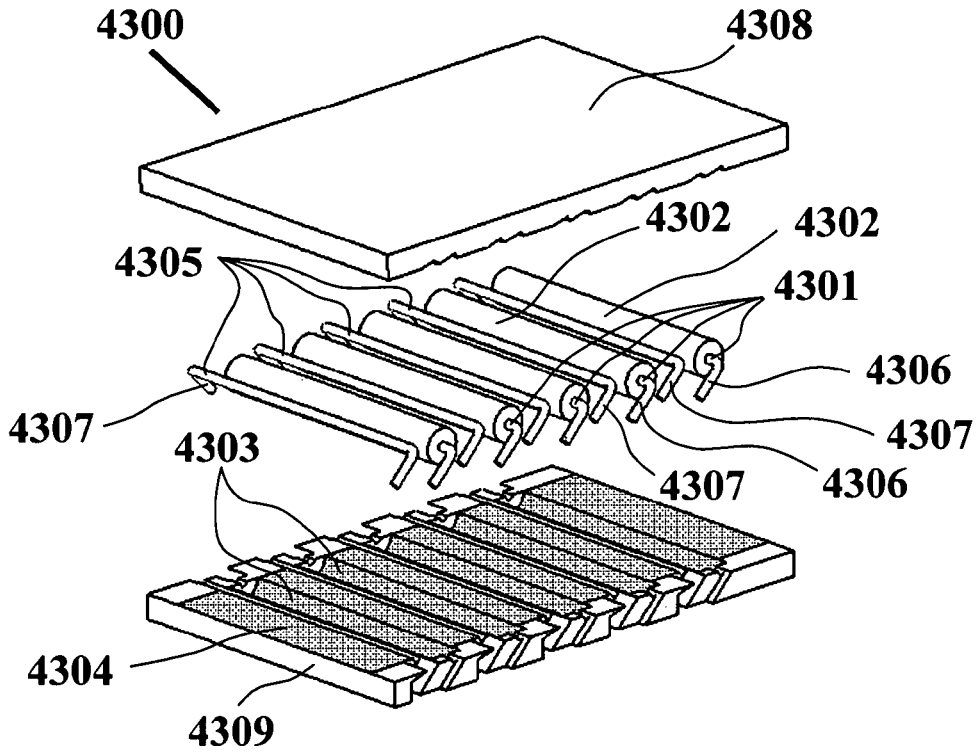
FIG. 43 illustrates an exploded view of the torsion bar conductors used in a coaxial transmission line.

FIG. 43 illustrates an embodiment of an electrical connector 4300 in which the torsion bar conductors 4301 are the center conductors in coaxial transmission lines. The torsion bar conductors 4301 are encased in dielectric tubes 4302, which are in turn encased in closely conforming channels 4303 in the top housing 4308 and the bottom housing 4309. The housings can be coated with a conductive film as indicated by the shaded area 4304. The torsion bar ground conductors 4305 are placed next to each coaxial transmission line. The torsion bar ground conductors 4305 route the ground signals from one end of the electrical connector 4300 to the other. When the electrical connector is forced down upon the electrical contact pads of one or more printed circuit boards, the tip sections 4306, 4307 rotate upward creating contact force.

Figure 44:
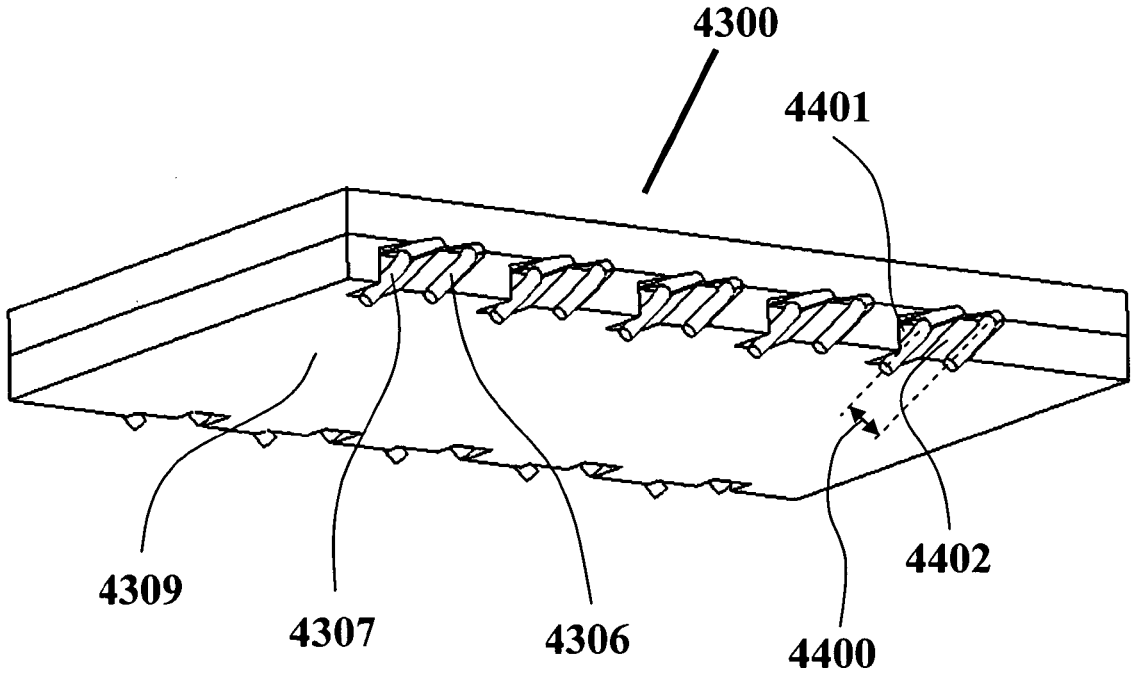
FIG. 44 illustrates the electrical connector in FIG. 43 in a perspective view from the bottom.

FIG. 44 illustrates a bottom view of the electrical connector 4300 in FIG. 43. The visible portion of a tip section 4306 of a torsion bar conductor 4301 can be spaced an appropriate distance 4400 away from the tip section 4307 of the torsion bar ground conductor 4305 to match the characteristic impedance of the coaxial structure. The distance 4400 can be adjusted by extending cavity 4401 deeper into the bottom housing 4309 than cavity 4402.

Figure 45:
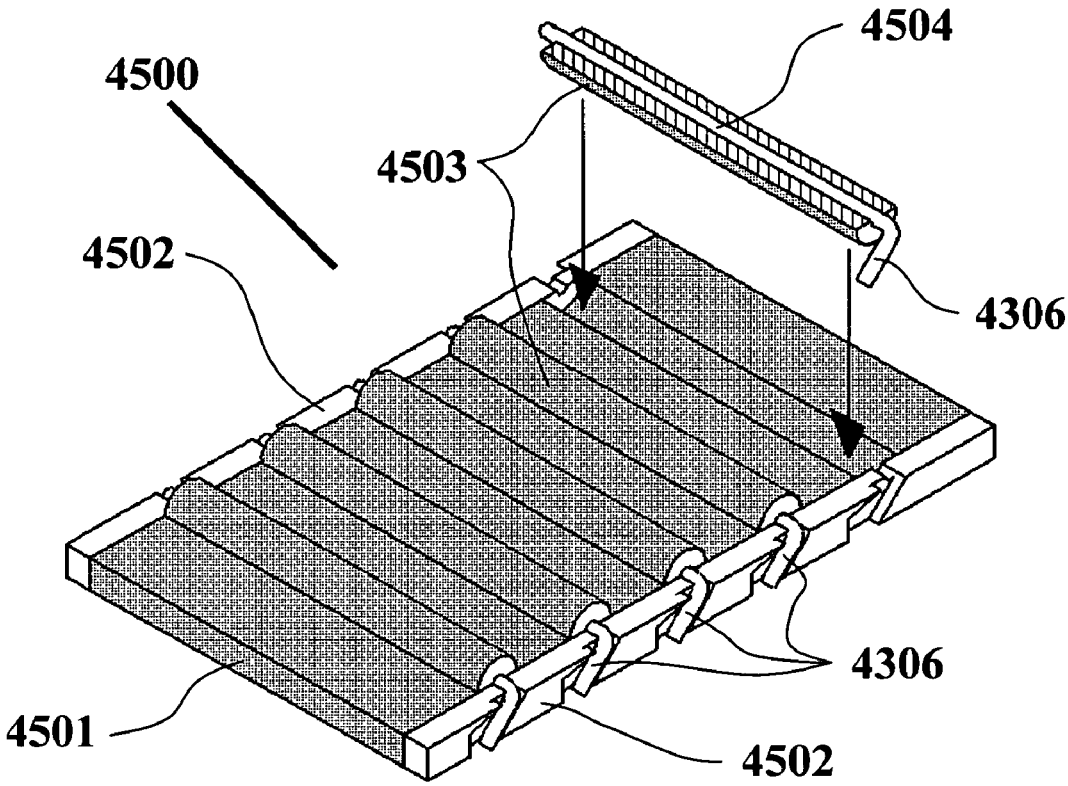
FIG. 45 illustrates an isometric view of an embodiment, the torsion bar conductors in a coaxial transmission line wherein the bottom housing's material is conductive.

FIG. 45 illustrates an embodiment, an electrical connector 4500 wherein torsion bar conductors 4504 in coaxial transmission lines are seated in the bottom housing 4501 comprised of a center portion (shown as the shaded area), whose material is conductive, and the two insulating strips 4502 residing on either side of the center portion and next to the tip sections 4306. The outer diameter of the round coaxial tubing 4503 is shown conductively coated, but does not necessarily have to be conductively coated. The last round coaxial tubing 4503 to the right is sectioned (shown by cross-hatching) to show the torsion bar conductor 4504 within.

Figure 46:
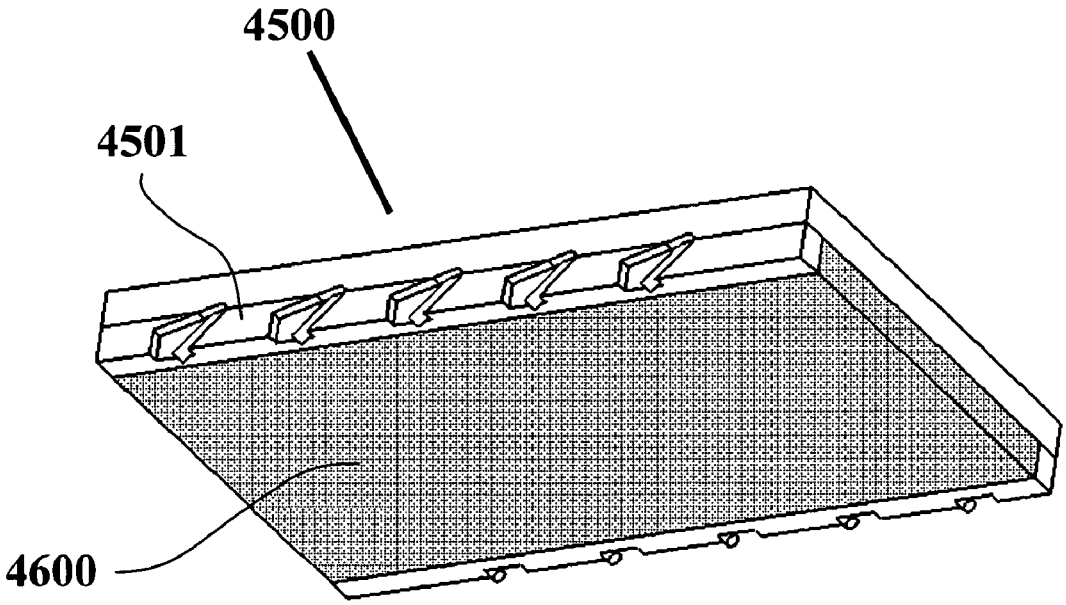
FIG. 46 illustrates a bottom view of the connector in FIG. 45 showing the conductive material in the bottom housing.

FIG. 46 illustrates a bottom view of the electrical connector 4500 in FIG. 45 that shows the conductive bottom surface 4600 of the bottom housing 4501 indicated by the shaded area. When the electrical connector 4500 is mated to a printed circuit board, the conductive bottom surface 4600 can make electrical contact to grounded areas of the printed circuit board by using compression contacts, conductive bumps, soldering, welding, conductive elastomeric films or other means. In FIGS. 43 through 46, the figures imply that the coaxial structure is cylindrical. However, the cross section profile of the coaxial transmission lines may be square, rectangular or some other shape.

Figure 47:
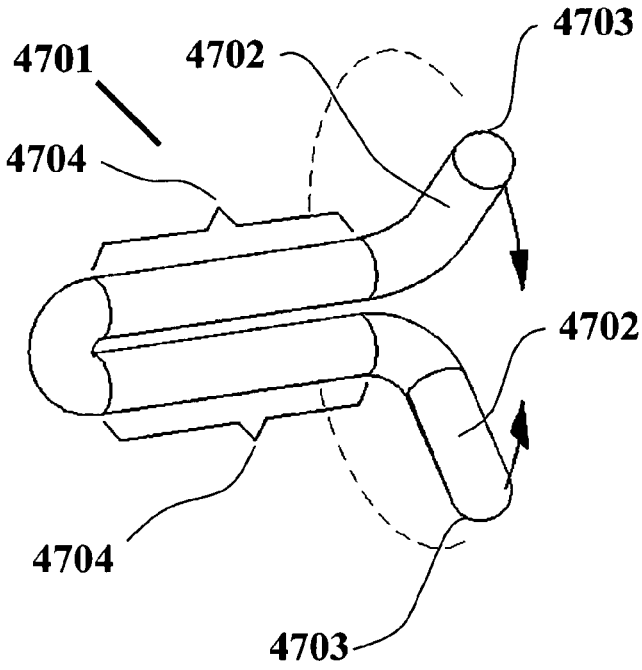
FIG. 47 illustrates an embodiment, a torsion bar conductor shaped for use in an interposer connector wherein the two electrical contact points rotate through the same plane.

FIG. 47 illustrates a vertical interposer conductor 4701 that can be used in an electrical interposer connector. The vertical interposer conductor 4701 is shaped so that the tip sections 4702 and the electrical contact points 4703 at the ends of the tip sections rotate in the same plane. The axes of rotation of the tip sections 4702 are the axes of the torsion bars 4704. The torsion bars 4704 can be enclosed within closely fitting cavities that confine the torsion bars 4704, but allow the torsion bars to twist due to the tip sections being rotated about the axes of the torsion bars. Because the axes of the torsion bars 4704 are parallel and connected at one end, the electrical contact points 4703 can be closer together vertically thus making the electrical interposer thinner than other interposer interconnection devices. The torsion bars 4704 can be made longer or shorter in the axial direction to adjust the value of the moment and thus the contact force at the electrical contact points 4703.

Figure 48:
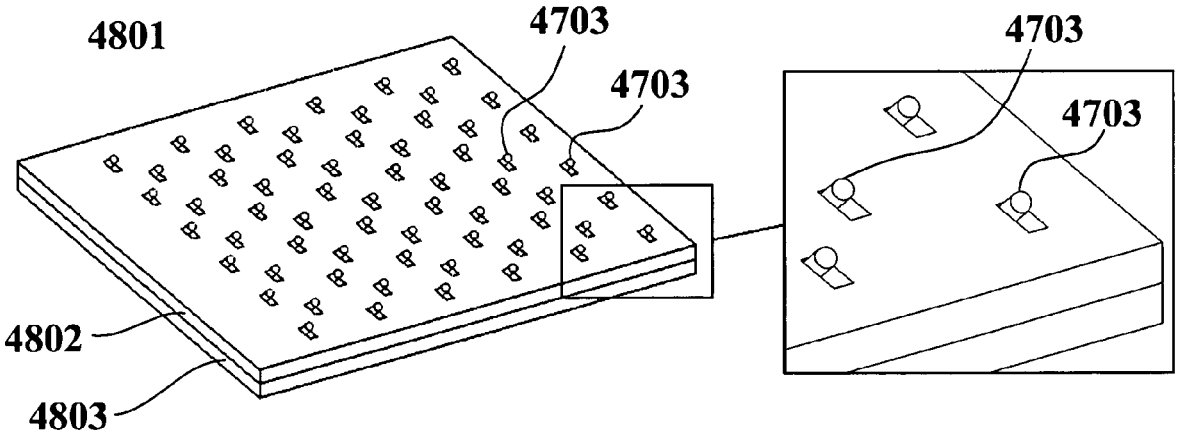
FIG. 48 illustrates a top isometric view of an embodiment, an electrical interposer connector that uses the torsion bar conductor shown in FIG. 47.

FIG. 48 illustrates an embodiment, an electrical interposer 4801 that has a plurality of torsion bar conductors 4701 embedded in closely conforming channels inside a top insulative layer 4802 and a bottom insulative layer 4803. The electrical contact points 4703 protrude through the top insulative layer 4802 and bottom insulative layer 4803. Because the electrical contact points 4703 below the electrical interposer 4801 are vertically aligned over the electrical contact points 4703 above the electrical interposer 4801, the electrical contact pads on the first printed circuit board can be vertically in line with the electrical contact pads on the second printed circuit board.

Figure 49:
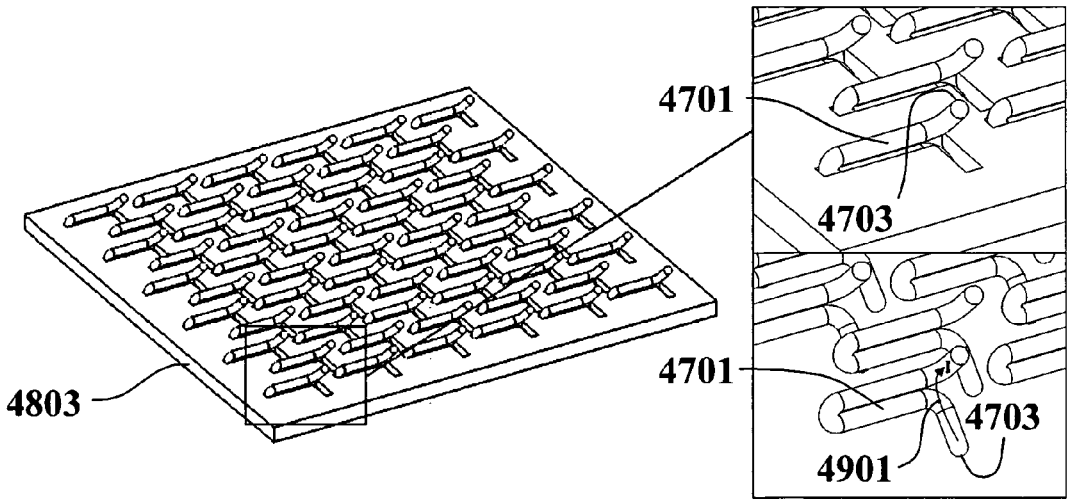
FIG. 49 illustrates the electrical interposer in FIG. 48 with the top housing removed.

FIG. 49 illustrates the electrical interposer 4801 with top insulative layer 4802 removed. The enlarged view on the top right shows the torsion bar conductors 4701 residing in cavities in the bottom insulative layer 4803. The enlarged view on the lower right illustrates the torsion bar conductors 4701 without the bottom insulative layer 4803 to show the torsion bar conductors' relationship and orientation to the insulative layers 4802, 4803 and to each other. The walls of the cavities within which the torsion bar conductors 4701 reside could have the shape of two closely conforming cylinders. If the cylindrical cavities are conductively coated, the signal's current (I) 4901 can travel as directly as possible from one electrical contact point 4703 on the torsion bar conductor 4701 to its other electrical contact point 4703 through the conductive coating thus making the torsion bar conductors 4701 less inductive.

Figure 50:
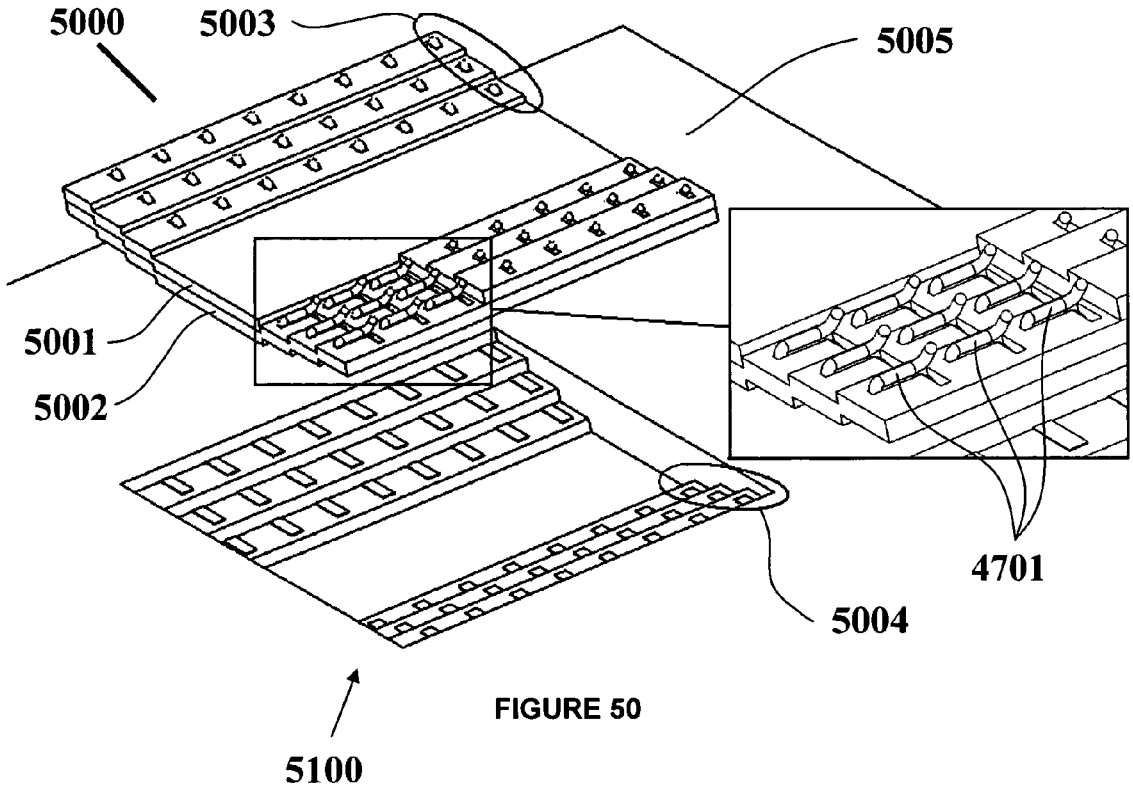
FIG. 50 illustrates the electrical interposer in FIG. 48, an embodiment, except with rows of torsion bar conductors in a stair step configuration that mate with electrical contact pads in a stair step configuration on a printed circuit board.

FIG. 50 illustrates an embodiment, a stair step electrical interposer 5000 with rows of torsion bar conductors 4701 captured between an upper insulative layer 5001 and a lower insulative layer 5002. The enlarged view to the right shows the upper insulative layer 5001 with a section removed that exposes the upper half of the torsion bar conductors 4701. The stair step configurations 5003, 5004 are shown in the stair step electrical interposer 5000 and in the well in the stair step printed circuit board 5005 respectively. A stair step electrical interposer may have rows of electrical contacts that may be at various angles or orientations to each other.

In FIGS. 48 and 50, portions of the insulative layers may be conductively coated or made conductive by other means to provide a ground return path for high frequency signals traveling through the electrical interposer 4801 or stair step electrical interposer 5000. When the geometry, dimensions and properties of the signal transmission line comprising the ground return path, dielectric material, and torsion bar conductors are tuned correctly, they create a high-speed, high-density transmission line with improved signal integrity.

Figure 51:
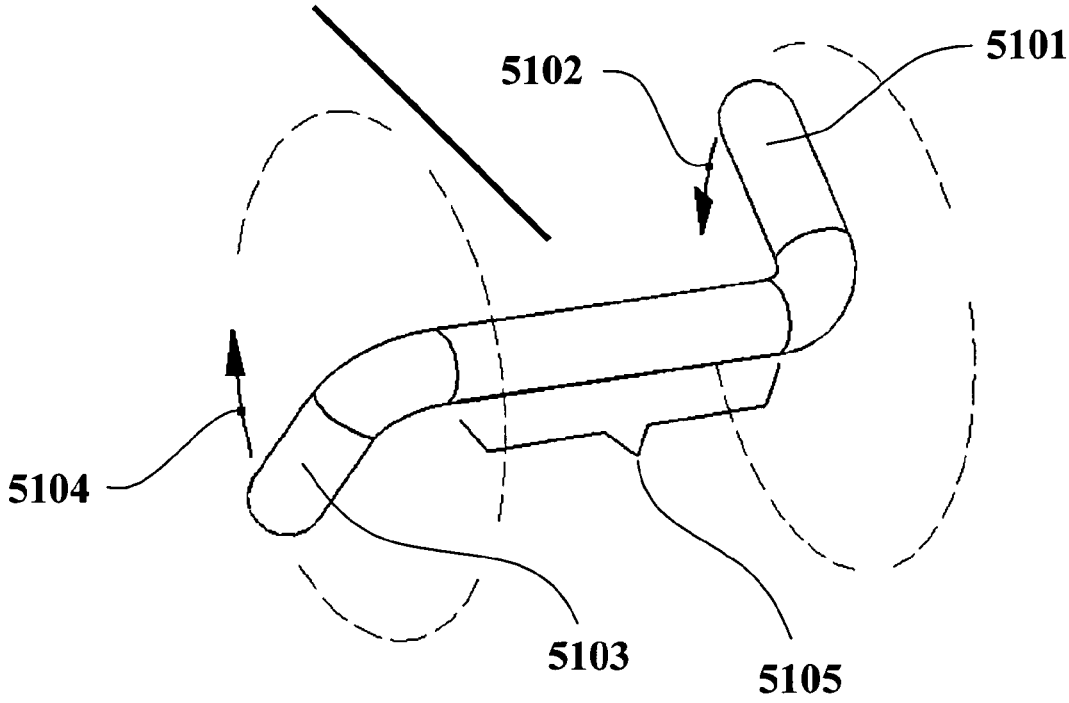
FIG. 51 is an embodiment of the torsion bar conductor shown in FIG. 47.

FIG. 51 illustrates an offset interposer conductor 5100 for use in electrical interposers. When actuated, tip section 5101 rotates in a counterclockwise direction 5102 and tip section 5103 rotates in a clockwise direction 5104. Channels in the insulative layers (not shown) in the electrical interposer capture the torsion bar 5105. The offset interposer conductor 5100 is smaller, simpler in design and easier to fabricate than torsion bar conductor 4701.

Figure 52A:
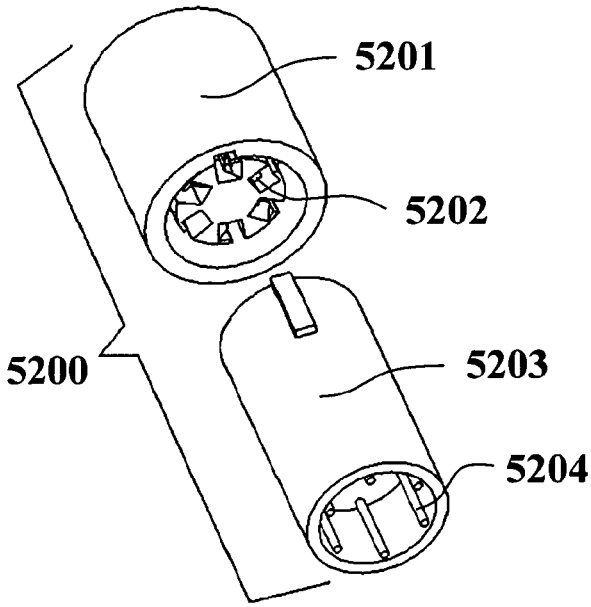
FIG. 52A illustrates an embodiment, torsion bar conductors in a circular conductor that mates axially.
Figure 52B:
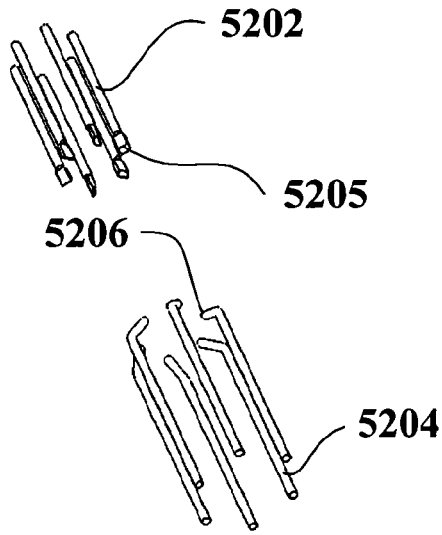
FIG. 52B illustrates the position and relationship of the torsion bar conductors in FIG. 52A without the connector housings.

FIGS. 52A and 52B illustrate another embodiment, an electrical circular connector system 5200 comprised of a plug electrical connector and a receptacle electrical connector, wherein a plug housing 5203 holds the torsion bar conductors 5204 in a circular arrangement. The mating receptacle conductors 5202 are arrayed inside a receptacle housing 5201 in a circular pattern. A surface on the end of the receptacle conductor 5202 is inclined at an angle so that it acts as a ramp 5205 for the torsion bar conductor's electrical contact 5206 as the two conductors are mated together. As the torsion bar conductor's electrical contact 5206 moves up the ramp 5205, the tip section twists and creates a moment in the torsion bar conductor. Torsion bar conductors in circular arrangements with larger or smaller diameters that are concentric with the aforementioned torsion bar conductors 5202, 5204 may be added to the electrical circular connector system 5200.

The end of a signal trace on a flexible circuit may be formed into an electrical contact pad that mates with the electrical contact 5206 on the end of the torsion bar conductor 5204. Thus a separate receptacle conductor 5202 would be not required. Either conductor 5202 or 5204 may be attached to conductive entities such as flexible circuit traces, wires in a cable, conductors in coaxial transmission lines or the like. The back end of each connector may be conductively attached to other electronic components such as printed circuit boards or IC packages by soldering, welding, compression contacts, conductive films or other means.

Figure 53A:
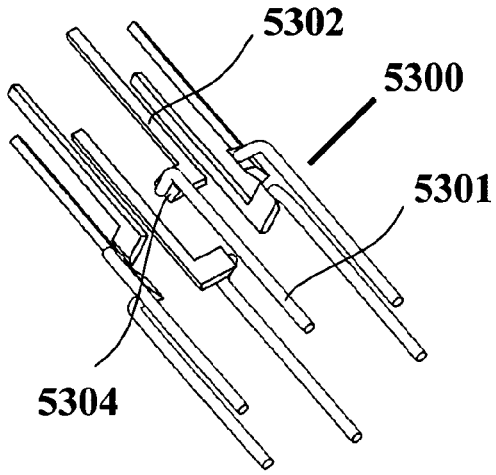
FIG. 53A illustrates an embodiment, torsion bar conductors wherein the plug and receptacle housings (not shown) in a circular connector have moved together axially but have not been rotated with respect to each other.
Figure 53B:
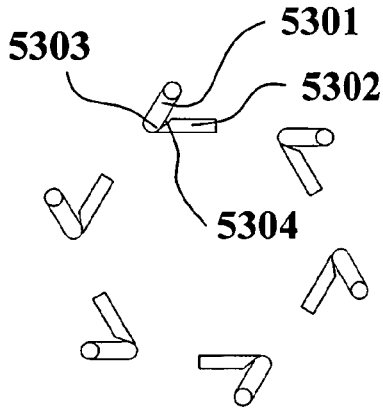
FIG. 53B illustrates a view looking down the axes of the torsion bar conductors in FIG. 53A.
Figure 54A:
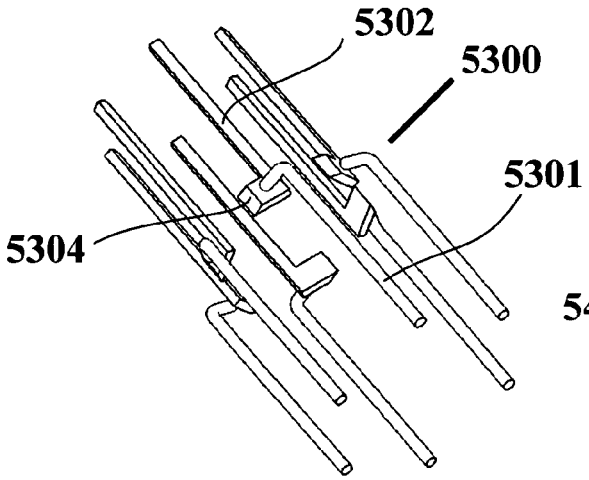
FIG. 54A illustrates torsion bar conductors after the plug and receptacle housings (not shown) in a mated circular connector have moved together axially and have been rotated with respect to each other.
Figure 54B:
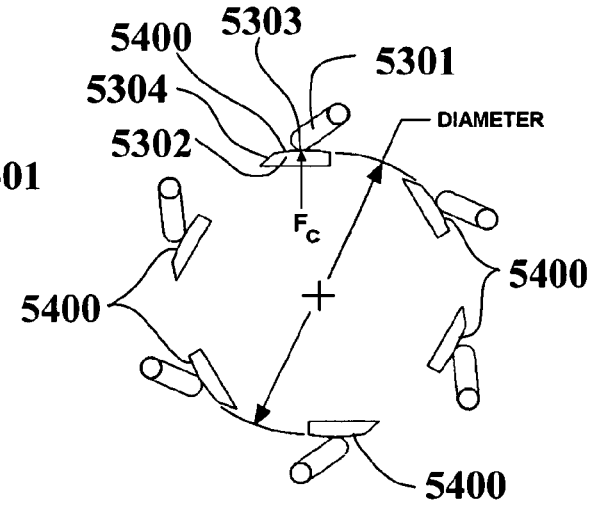
FIG. 54B illustrates an end view looking down the axes of the conductors in FIG. 54A.

FIG. 53A shows another embodiment, an electrical circular connector system 5300 in which the torsion bar conductors 5301 are in a circular array residing inside a circular plug housing (not shown) and the receptacle conductors 5302 are in a circular array residing inside a circular receptacle housing (not shown). In FIGS. 53A and 53B, the housings have been drawn together in the housings' axial direction, but not rotated with respect to each other so that the electrical contacts 5303 on the torsion bar conductors 5301 are at the bottom of the receptacle conductors' ramps 5304. The next step in mating the connector in FIGS. 53A, 53B is illustrated in FIGS. 54A, 54B wherein rotation of the housings with respect to each other causes the electrical contacts 5303 on the torsion bar conductors 5301 to travel up the ramps 5304 on the receptacle conductors 5302. This action twists the torsion bar conductors 5301 creating contact force $F_C$. As the electrical contacts 5303 travels beyond the ramps 5304 onto the curved surfaces 5400, the torsion bar conductors 5301 stop twisting further. The latter occurs because the radius of curvature on all curved surfaces 5400 of each receptacle conductor 5302 is equal to one half the diameter shown and all the curved surfaces 5400 are coincident with a cylinder defined by the diameter shown. Thus if the housings do not rotate to an exact predefined angular position, then the value of the contact force does not vary as in a receptacle conductor wherein curved surfaces 5400 were instead flat surfaces. If the housings rotate to mate the conductors, the rotation action can lock the connector halves together. In addition, torsion bar conductors in circular arrangements with larger or smaller diameters that are concentric with the aforementioned torsion bar conductors 5301, 5302 may be added to the electrical circular connector system 5300.

The torsion bar conductors in FIGS. 52A through 54B are arrayed in circular configurations. However, they may also be arrayed in rows and columns in rectangular, square or other geometric arrangements. When the conductors are in these other configurations, the connectors may be mated by either drawing the connector housings together in an axial direction or sliding the conductors' electrical contact surfaces over each other from a number of directions.

Figure 55A:
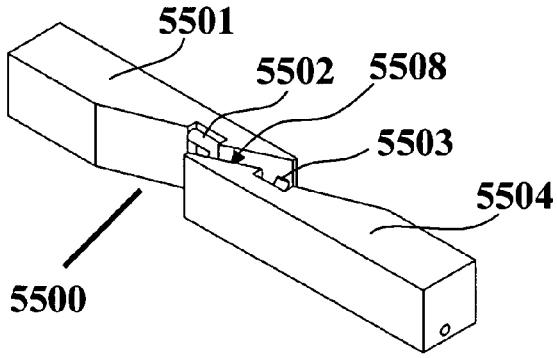
FIG. 55A illustrates an embodiment, two electrical connector assemblies, before mating occurs, showing torsion bar conductors inside connector bodies.
Figure 55B:
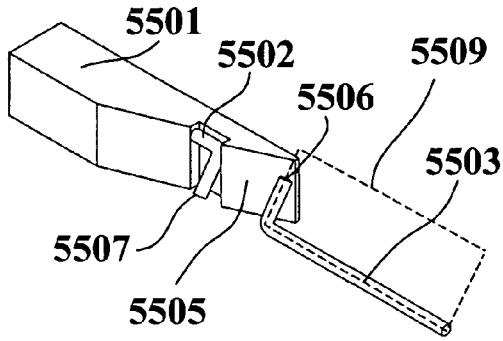
FIG. 55B illustrates the two electrical connector assemblies in FIG. 55A with the right connector body removed.
Figure 56A:
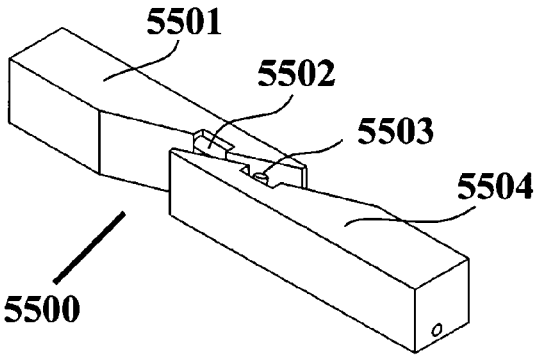
FIG. 56A illustrates the two electrical connector assemblies in FIG. 55A partially mated.
Figure 56B:
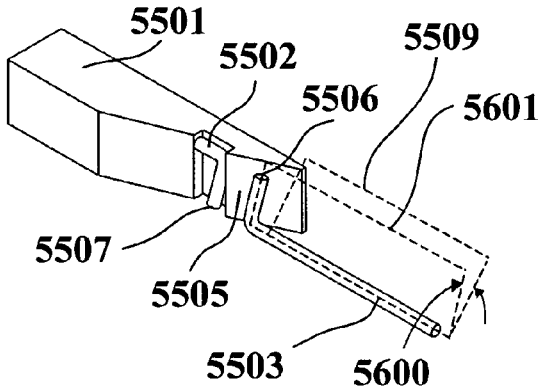
FIG. 56B illustrates the two electrical connector assemblies in FIG. 56A with the right connector body removed.
Figure 57A:
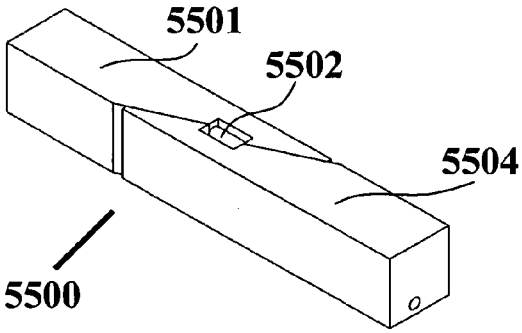
FIG. 57A illustrates the two electrical connector assemblies in FIG. 55A fully mated.
Figure 57B:
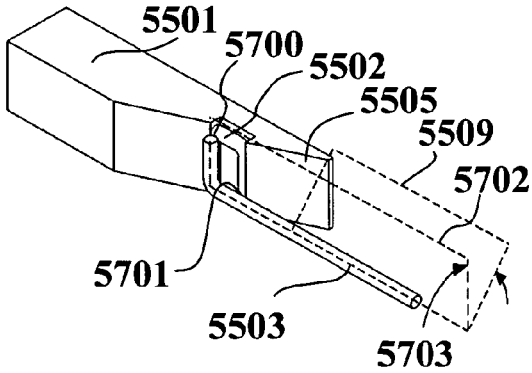
FIG. 57B illustrates the two electrical connector assemblies in FIG. 57A with the right connector body removed.

FIGS. 55A through 58 illustrate another embodiment, an arrayed conductor electrical connector system in which the tip sections on torsion bar conductors make electrical contact with the torsion bars on the mating torsion bar conductors. In FIGS. 55A, 55B, torsion bar conductors 5502, 5503 are enclosed in connector bodies 5501, 5504 respectively. FIG. 55B illustrates the assembly in FIG. 55A without connector body 5504 in which connector body 5504 is a mirror image of connector body 5501. The tip section 5506 on torsion bar conductor 5503 is beginning to slide to the left on ramp 5505 on connector body 5501. In the same manner, the end of the tip section 5507 on torsion bar conductor 5502 is simultaneously sliding to the right on ramp 5508 on connector body 5504. The axis of the moment arm and the axis of the torsion bar in torsion bar conductor 5503 define the plane 5509. Torsion bar conductor 5502 also has a plane (not shown), defined in the same manner, which is parallel to plane 5509. In FIGS. 56A, 56B, the torsion bar conductors 5502, 5503 are brought closer together causing ends of the tip sections 5506, 5508 to travel farther along the ramps 5505, 5508. This causes the tip sections 5506, 5508 of torsion bar conductors 5502, 5503 to rotate through intermediate angle 5600 defined by planes 5509 and 5601. In FIGS. 57A, 57B, the tip sections 5506, 5508 of torsion bar conductors 5502, 5503 have moved past the guiding ramps 5505, 5508 and the electrical connector system 5500 has fully mated. The torsion sections of torsion bar conductors 5502, 5503 are fully twisted which provides contact force at electrical contact points 5700, 5701. Thus the tip sections of torsion bar conductors 5502, 5503 have rotated through final angle 5703 defined by planes 5509 and 5702. The cylindrical surface of each tip section contacts the cylindrical surface of the torsion bar on the mating torsion bar conductor. The axes of these cylindrical surfaces cross each other, which provides a reliable electrical contact geometry. The torsion bar conductors illustrated in FIGS. 55A through 57B can arrayed in circular configurations or in rows and columns in rectangular, square or other geometric arrangements inside two-part electrical connector systems.

Figure 58:
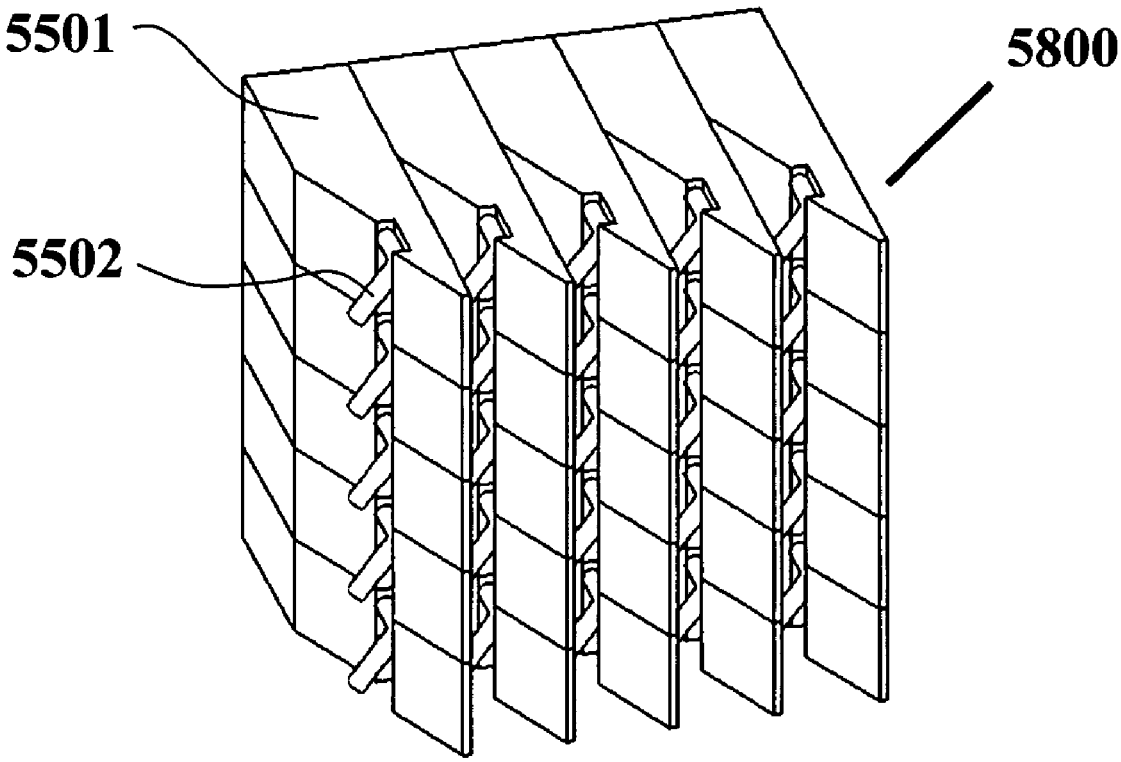
FIG. 58 illustrates an embodiment, a rectangular array of the electrical connector assemblies from FIG. 55A.

FIG. 58 illustrates an electrical connector assembly 5800, which is one half of a two-part, rectangular, electrical connector system. The electrical connector assembly 5800 is composed of an array of connector bodies 5501 and torsion bar conductors 5502. An electrical connector assembly (not shown) composed of an array of connector bodies 5503 and torsion bar conductors 5504 mates with electrical connector assembly 5800 and comprises the two-part, rectangular, electrical connector system. The electrical connector assemblies may also be arrayed in circular configurations or other geometric arrangements.

In FIGS. 52A through 58, torsion bar conductors mate with other torsion bar conductors, as illustrated by FIGS. 55A through 57B in two-part, electrical connector systems. These embodiments improve signal maintenance during shock and vibration, establish electrical connections with redundant electrical contact points, and reduce or eliminate capacitive stubs.

Although the invention has been described with reference to specific exemplary embodiments thereof, it will be evident that various modifications and changes may be made thereto without departing from the broader spirit and scope of the invention. The specification and drawings are, accordingly, to be regarded in an illustrative rather than a restrictive sense.

The invention claimed is:

1. An electrical connector comprising:

a rigid torsion bar conductor with i) a linear central section aligned on a longitudinal axis, the linear central section extending between a first bend and a second bend;

ii) a first moment arm aligned on a first axis and extending outward from the linear central section at the first bend; and iii) a second moment arm aligned on a second axis and extending outward from the linear central section at the second bend; and a first contact forcibly engaged with the first moment arm and exerting a first force that is transmitted through the first moment arm and twists the linear central section in a first direction circumferential to the central axis; and, a second contact forcibly engaged with the second moment arm and exerting a second force that is transmitted through the second moment arm, twisting the linear central section circumferential to the central axis and in a direction opposite the first direction;

the rigid torsion bar conductor and the first and the second contacts arranged such that the rigid torsion bar conductor is free to rotate about the longitudinal axis in response to said first and said second forces.

2. The electrical connector of claim 1, wherein the rigid torsion bar conductor consists essentially of a bent metal rod.

3. The electrical connector of claim 2, wherein at least a portion of the bent metal rod is comprises a cylindrical shape.

4. The electrical connector of claim 1, further comprising a connector body configured to align the longitudinal axis of the linear central section along the longitudinal a predetermined axis.

5. The electrical connector of claim 1 wherein the linear central section is symmetrically formed around the longitudinal axis.

6. The electrical connector of claim 1 wherein a mid-point defines a point on the linear central section half way between the first and second bends, and wherein the linear central section extends symmetrically from the mid point outward, along the longitudinal axis.

7. The electrical connector of claim 1 wherein the first and second moment arms are approximately parallel to each other; and further wherein the first and second contacts are arranged such that said first and said second forces have directions approximately perpendicular to each other.

* * * * *